US009445631B1

(12) United States Patent
Patel et al.

(10) Patent No.: US 9,445,631 B1
(45) Date of Patent: Sep. 20, 2016

(54) CONTAINER FOR SMOKELESS TOBACCO PRODUCTS AND RELATED PACKAGED PRODUCT ASSEMBLY AND METHOD

(71) Applicant: R.J. Reynolds Tobacco Company, Winston-Salem, NC (US)

(72) Inventors: Pankaj Patel, Clemmons, NC (US); Terry LeBron Howell, Knoxville, TN (US); Erik Michael Hershey, Summerfield, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 14/663,987

(22) Filed: Mar. 20, 2015

(51) Int. Cl.

| | |
|---|---|
| ***A24F 23/00*** | (2006.01) |
| ***B65D 43/02*** | (2006.01) |
| ***A61J 1/00*** | (2006.01) |
| ***B65D 53/00*** | (2006.01) |

(52) U.S. Cl.
CPC ..... *A24F 23/00* (2013.01); *A61J 1/00* (2013.01); *B65D 43/02* (2013.01); *B65D 53/00* (2013.01)

(58) Field of Classification Search
CPC ..... A24F 23/00
USPC ..... 206/37, 38, 38.1, 236, 242; 220/795, 220/796–806
See application file for complete search history.

(56) References Cited

U.S. PATENT DOCUMENTS

| | | | |
|---|---|---|---|
| 411,773 | A | 10/1889 | Atkinson |
| 464,933 | A | 12/1891 | Bradley |
| D26,315 | S | 11/1896 | Miller |
| D28,413 | S | 3/1898 | Taite |
| 663,415 | A | 12/1900 | Charles |
| 1,072,820 | A | 9/1913 | Carnes |
| 1,083,104 | A | 12/1913 | Johnson |
| 1,212,147 | A | 1/1917 | Peterson |
| 1,331,470 | A | 2/1920 | Luckett |
| 1,344,650 | A | 6/1920 | Peterson |
| 1,381,831 | A | 6/1921 | Heeren |
| 1,667,460 | A | 4/1928 | Hussey |
| 1,992,152 | A | 2/1935 | Yeates |

(Continued)

FOREIGN PATENT DOCUMENTS

| | | |
|---|---|---|
| CA | 1072895 | 3/1980 |
| CA | 2547369 | 11/2006 |

(Continued)

OTHER PUBLICATIONS

IMACS User's Guide; 471—Tin Cans—Aug. 2001 (9 pgs.).

(Continued)

*Primary Examiner* — Bryon Gehman
(74) *Attorney, Agent, or Firm* — Womble Carlyle Sandridge & Rice LLP

(57) ABSTRACT

A container configured to hold one or more units of a product is provided. The container may include a lid and a base. The lid may include a top wall and one or more lid sidewalls extending to a lower lip. The base may include a bottom wall and one or more base sidewalls extending to an upper lip. A channel may be defined at the one or more base sidewalls that extend around the perimeter of the base. A sealing member may be received in the channel. The sealing member may be configured to engage an inner surface of the one or more lid sidewalls when the lid is coupled to the base. Thereby, a storage compartment defined by the base may be sealed shut. A related method is also provided.

19 Claims, 14 Drawing Sheets

(56) References Cited

U.S. PATENT DOCUMENTS 2,023,341 A 12/1935 Downes-Shaw et al.
2,047,951 A 7/1936 Eberhart
2,047,977 A 7/1936 McGowan
2,109,805 A 3/1938 Stewart
2,117,228 A 5/1938 Stuchbery
2,206,534 A 7/1940 Higbee
2,332,245 A 10/1943 Moll
2,339,343 A 1/1944 Magnesen
2,403,131 A 7/1946 Smith
2,412,528 A 12/1946 Morrell
2,415,609 A 2/1947 Sebell
2,523,251 A 9/1950 Pantalone et al.
2,551,615 A 5/1951 Maher
2,977,019 A 3/1961 Henchert
3,010,596 A 11/1961 Williams et al.
3,017,048 A 1/1962 Foye
D193,219 S 7/1962 Burdick et al.
3,042,247 A 7/1962 Bonnet
3,088,830 A 5/1963 Graham
3,170,588 A 2/1965 Lyon, Jr.
3,206,016 A 9/1965 Fowle et al.
3,292,810 A 12/1966 Schechter
3,362,556 A 1/1968 Waldrum
3,380,621 A 4/1968 Rissberger, Jr. et al.
3,387,640 A 6/1968 Butler
3,392,873 A 7/1968 Old, Jr.
3,437,224 A 4/1969 Williams
3,445,023 A 5/1969 Giessler et al.
3,558,036 A 1/1971 DeVoe
3,574,147 A 4/1971 Giessler et al.
3,610,306 A 10/1971 Summers
3,721,365 A 3/1973 Saunders
3,796,681 A 3/1974 Ratliff et al.
3,811,592 A 5/1974 Dye
3,813,904 A * 6/1974 Wallskog ..... C08L 23/10 70/169
3,874,556 A 4/1975 Finkelston, Jr.
3,894,654 A 7/1975 Frankenberg
3,907,953 A 9/1975 Wheeler
3,910,444 A 10/1975 Foster
4,008,930 A 2/1977 Swainson
4,037,746 A 7/1977 Ver Hage
4,098,421 A 7/1978 Foster
4,190,170 A 2/1980 Boyd
4,202,462 A 5/1980 Imber
4,442,971 A 4/1984 Helms
4,562,685 A 1/1986 Tomita et al.
4,569,438 A * 2/1986 Sheffler ..... A45D 40/22 206/37
4,612,943 A 9/1986 Meinkowsky
4,615,439 A 10/1986 Weissenfels
4,646,933 A 3/1987 Jurczenia et al.
4,660,577 A 4/1987 Sensabaugh et al.
4,703,765 A 11/1987 Paules et al.
4,705,165 A 11/1987 Thieke
4,711,687 A 12/1987 Paules
4,715,496 A 12/1987 Hackmann
4,727,999 A 3/1988 Gach
4,781,288 A * 11/1988 Wing ..... A45C 11/24 220/4.22
4,846,361 A 7/1989 Haffner
4,850,504 A 7/1989 Grindrod et al.
5,259,526 A 11/1993 Stolzman
5,443,853 A 8/1995 Hayes
5,460,287 A 10/1995 Cargile et al.
5,538,154 A 7/1996 Von Holdt
5,566,568 A 10/1996 Rojek
5,566,854 A 10/1996 Rojek
5,660,290 A 8/1997 Hayes
5,676,272 A 10/1997 Baerenwald
5,686,127 A 11/1997 Stockley, III et al.
5,752,599 A 5/1998 Veltman
5,782,371 A 7/1998 Baerenwald et al.
5,791,473 A 8/1998 Decker et al.
5,794,814 A 8/1998 Baerenwald
D407,972 S 4/1999 Hilton
D412,786 S 8/1999 Killinger
5,947,320 A * 9/1999 Bordner ..... B65D 43/0218 220/321
6,032,792 A 3/2000 Faraj
D427,432 S 7/2000 Au et al.
6,102,227 A 8/2000 Cochrane
6,170,490 B1 1/2001 Barrow
6,298,857 B1 10/2001 Schmidt
6,364,152 B1 * 4/2002 Poslinski ..... A47J 47/10 220/795
D456,713 S 5/2002 Bried et al.
D460,692 S 7/2002 Cumberbatch
D462,613 S 9/2002 Bried et al.
D464,886 S 10/2002 Bried et al.
6,477,823 B1 11/2002 Kitterman et al.
D469,607 S 2/2003 Wolff
D476,575 S 7/2003 Steele, IV et al.
6,726,006 B1 4/2004 Funderburk et al.
D494,474 S 8/2004 Houk et al.
D499,025 S 11/2004 Houk et al.
D510,524 S 10/2005 Houk et al.
D512,636 S 12/2005 Pace
D513,386 S 1/2006 Pace et al.
D514,936 S 2/2006 Pace et al.
D515,426 S 2/2006 Pace et al.
D515,429 S 2/2006 Pace
D515,439 S 2/2006 Pace
D515,928 S 2/2006 Pace
7,014,039 B2 3/2006 Henson et al.
D518,728 S 4/2006 Frantz
D523,752 S 6/2006 Bried et al.
7,059,492 B2 6/2006 Giraud et al.
D525,120 S 7/2006 Maskell et al.
D527,995 S 9/2006 Tanner
D531,036 S 10/2006 Bried et al.
D541,176 S 4/2007 Bried
D548,070 S 8/2007 Swain
D587,109 S 2/2009 Lyon et al.
D592,494 S 5/2009 Wichowski
D592,498 S 5/2009 Cronin
7,537,110 B2 5/2009 Kutsch et al.
D594,154 S 6/2009 Patel et al.
D600,855 S 9/2009 Krohn
D612,094 S 3/2010 Bellamah et al.
7,798,319 B1 9/2010 Bried et al.
D625,178 S 10/2010 Bailey et al.
D630,505 S 1/2011 Westemeyer et al.
D630,525 S 1/2011 Patel et al.
D631,353 S 1/2011 Gelardi et al.
D631,354 S 1/2011 Gelardi et al.
D631,747 S 2/2011 Gelardi et al.
D638,297 S 5/2011 Gelardi et al.
7,946,450 B2 5/2011 Gelardi et al.
D639,162 S 6/2011 Gelardi et al.
D639,163 S 6/2011 Gelardi et al.
D640,131 S 6/2011 Gibson et al.
D646,159 S 10/2011 Bellamah et al.
D646,966 S 10/2011 Gill et al.
8,033,425 B2 10/2011 Gelardi
D649,284 S 11/2011 Patel et al.
8,051,979 B2 11/2011 Smith et al.
8,066,123 B2 11/2011 Gelardi
D650,268 S 12/2011 Gibson et al.
8,096,411 B2 1/2012 Bailey et al.
8,117,807 B2 2/2012 Bellamah et al.
D658,377 S 5/2012 Corwin et al.
D665,253 S 8/2012 Bellamah et al.
D667,301 S 9/2012 Jones et al.
D667,302 S 9/2012 Jones et al.
D667,303 S 9/2012 Jones et al.
D667,304 S 9/2012 Jones et al.
D673,848 S 1/2013 Bailey et al.
D674,688 S 1/2013 Loftin et al.
D675,516 S 2/2013 Horton et al.
D676,321 S 2/2013 Jones et al.
8,397,945 B2 3/2013 Gelardi et al.
8,458,996 B2 6/2013 Bried et al.
D688,938 S 9/2013 Bailey et al.

(56) References Cited

U.S. PATENT DOCUMENTS

| | | | |
|---|---|---|---|
| D690,588 | S | 10/2013 | Pipes et al. |
| D692,298 | S | 10/2013 | Pipes et al. |
| D694,102 | S | 11/2013 | Bellamah et al. |
| D704,050 | S | 5/2014 | Pipes et al. |
| 8,910,781 | B2 | 12/2014 | Pipes et al. |
| 2003/0111359 | A1 | 6/2003 | Seliga et al. |
| 2003/0188442 | A1 | 10/2003 | Imer |
| 2004/0217116 | A1 | 11/2004 | Offerman et al. |
| 2005/0279657 | A1 | 12/2005 | Bjerregaard et al. |
| 2006/0054626 | A1 | 3/2006 | Delcroix et al. |
| 2006/0060480 | A1 | 3/2006 | Budd |
| 2006/0101564 | A1 | 5/2006 | Powdermaker |
| 2006/0118589 | A1 | 6/2006 | Arnarp et al. |
| 2008/0029116 | A1 | 2/2008 | Robinson et al. |
| 2008/0156338 | A1 | 7/2008 | Winterson et al. |
| 2008/0156805 | A1 | 7/2008 | Perry et al. |
| 2008/0202956 | A1 | 8/2008 | Welk et al. |
| 2008/0210249 | A1 | 9/2008 | Luzenberg |
| 2008/0215440 | A1 | 9/2008 | Peterson et al. |
| 2009/0000968 | A1 | 1/2009 | Smith et al. |
| 2009/0014343 | A1 | 1/2009 | Clark et al. |
| 2009/0014450 | A1 | 1/2009 | Bjorkholm |
| 2009/0223988 | A1 | 9/2009 | Wichowski |
| 2010/0012534 | A1 | 1/2010 | Hoffman |
| 2010/0018882 | A1 | 1/2010 | St. Charles |
| 2010/0018883 | A1 | 1/2010 | Patel |
| 2010/0043359 | A1 | 2/2010 | Skiffington et al. |
| 2010/0065076 | A1 | 3/2010 | Bergstrom et al. |
| 2010/0065077 | A1 | 3/2010 | Lofgreen-Ohrn et al. |
| 2010/0133140 | A1 | 6/2010 | Bailey et al. |
| 2011/0000931 | A1 | 1/2011 | Gelardi et al. |
| 2011/0011866 | A1 | 1/2011 | Dunwoody |
| 2011/0186579 | A1 | 8/2011 | Bailey et al. |
| 2011/0204074 | A1 | 8/2011 | Gelardi et al. |
| 2012/0074157 | A1 | 3/2012 | Dunwoody |
| 2012/0193265 | A1 | 8/2012 | Patel et al. |
| 2012/0285125 | A1 | 11/2012 | Bailey |
| 2013/0008809 | A1* | 1/2013 | Cortez ..... A24F 23/00 206/265 |
| 2013/0146610 | A1 | 6/2013 | Gelardi et al. |
| 2013/0319886 | A1 | 12/2013 | Ledermann |
| 2014/0001194 | A1 | 1/2014 | Pipes et al. |
| 2014/0197054 | A1 | 7/2014 | Pipes et al. |

FOREIGN PATENT DOCUMENTS

| | | |
|---|---|---|
| CH | 694145 | 8/2004 |
| DE | 202004007079 | 7/2004 |
| EP | 0219297 | 4/1987 |
| EP | 0 806 367 | 11/1997 |
| FR | 825824 | 3/1938 |
| FR | 1565966 | 5/1969 |
| FR | 2361278 | 3/1978 |
| GB | 340646 | 1/1931 |
| GB | 410775 | 5/1934 |
| GB | 443073 | 2/1936 |
| GB | 443557 | 3/1936 |
| GB | 451222 | 7/1936 |
| GB | 472427 | 9/1937 |
| GB | 593653 | 10/1947 |
| GB | 693074 | 6/1953 |
| GB | 887480 | 1/1962 |
| GB | 910525 | 11/1962 |
| GB | 1004671 | 9/1965 |
| GB | 1159199 | 7/1969 |
| GB | 1 393 875 | 5/1975 |
| GB | 1 458 206 | 12/1976 |
| GB | 1 473 643 | 5/1977 |
| GB | 1 536 671 | 12/1978 |
| GB | 2 136 775 | 9/1984 |
| JP | 2005-231720 | 9/2005 |
| WO | WO 98/19931 | 5/1998 |
| WO | WO 99/25623 | 5/1999 |
| WO | WO 2005/084372 | 9/2005 |
| WO | WO 2005/108233 | 11/2005 |
| WO | WO 2009/000829 | 12/2008 |
| WO | WO 2012/122137 A1 | 9/2012 |

OTHER PUBLICATIONS

Shabby Chic Advertising Tin Vintage Mahogany Flake Tobacco by ChocolateBoxCottage; Tobacco tin alleged to have been on-sale prior to 1950; Website visited Feb. 10, 2014; http://www.etsy.com/listing/129091690/shabby-chic-advertising-tin-vintage?ref=sr_gallery_29&ga_search_query=tobacco+tin&ga_view_type=gallery&ga_ship_to=US&ga_page=35&ga_search_type=all.

IDS Packaging Product Information; Metal Closures (Huddersfield) Ltd.; Vacuum Sealed Tins, Tobacco Snuff Packaging; Medicated No. 99 Tin http://www.idspackaging.com/packaging/europe/Vacuum_sealed_tins/111/products.html website visited Aug. 1, 2014.

Photo of top of Medicated No. 99 Snuff container. Exact public availability date unknown, but believed to be before Jan. 11, 2013 for purposes of examination. (IMG_20140031_161225_476).

Photo of interior of Medicated No. 99 Snuff container. Exact public availability date unknown, but believed to be before Jan. 11, 2013 for purposes of examination. (IMG_20140331_161235_273).

Photo of exterior of Medicated No. 99 Snuff container. Exact public availability date unknown, but believed to be before Jan. 11, 2013 for purposes of examination. (IMG_20140415_090723_768).

Photo of Medicated No. 99 Snuff sealed container. Exact public availability date unknown, but believed to be before Jan. 11, 2013 for purposes of examination. (IMG_20140415_105636_529).

Photo of inner view of Medicated No. 99 Snuff container showing gasket in lid. Exact public availability date unknown, but believed to be before Jan. 11, 2013 for purposes of examination. (IMG_20140415_090800_886).

Photo of Medicated No. 99 Snuff container showing gasket in lid, and exterior and exterior of container. Exact public availability date unknown, but believed to be before Jan. 11, 2013 for purposes of examination. (IMG_20140415_090852_548).

Photo of exteriors of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140331_161335_917).

Photo of interiors of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140031_161356_684).

Photo of bottoms of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140331_161252_390).

Photo of top of Peterson Irish Whiskey Tobacco Product container. Exact public availability date unknown, but believed to be before Jan. 11, 2013 for purposes of examination. (IMG_20140031_100403_976).

Photo of interior of Peterson Irish Whiskey Tobacco Product container. Exact public availability date unknown, but believed to be before Jan. 11, 2013 for purposes of examination. (IMG_20140031_100415_820).

Photo of top of Moontrance Pipe Tobacco container. Exact public availability date unknown, but believed to be before Jan. 11, 2013 for purposes of examination. (IMG_20140331_100441_879).

Photo of bottom of Moontrance Pipe Tobacco container. Exact public availability date unknown, but believed to be before Jan. 11, 2013 for purposes of examination. (IMG_20140331_100451_768).

Photo of interior of Moontrance Pipe Tobacco container. Exact public availability date unknown, but believed to be before Jan. 11, 2013 for purposes of examination. (IMG_20140331_100501_217).

Photo of top of Mac Baren Honey & Chocolate Loose Cut Pipe Tobacco container. Exact public availability date unknown, but

(56) References Cited

OTHER PUBLICATIONS believed to be before Jan. 11, 2013 for purposes of examination. (IMG_20140328_154924_558).
Photo of interior of Mac Baren Honey & Chocolate Loose Cut Pipe Tobacco container. Exact public availability date unknown, but believed to be before Jan. 11, 2013 for purposes of examination. (IMG_20140328_155015_232).
Photo of bottom of Mac Baren Honey & Chocolate Loose Cut Pipe Tobacco container. Exact public availability date unknown, but believed to be before Jan. 11, 2013 for purposes of examination. (IMG_20140328_154857_504).
Photo of exterior of lid and interior of base of Flying Dutchman Tobacco Product container. Exact public availability date unknown, but believed to be before Jan. 11, 2013 for purposes of examination. (IMG_20140328_153834_102).
Photo of interior of Flying Dutchman Tobacco Product container. Exact public availability date unknown, but believed to be before Jan. 11, 2013 for purposes of examination. (IMG_20140328_153804_663).
Photo of top of Escudo Navy De Luxe Fine Tobacco container. Exact public availability date unknown, but believed to be before Jan. 11, 2013 for purposes of examination. (IMG_20140328_15706_741).
Photo of interior of Escudo Navy De Luxe Fine Tobacco container. Exact public availability date unknown, but believed to be before Jan. 11, 2013 for purposes of examination. (IMG_20140328_151805_943).
Photo of interior of Escudo Navy De Luxe Fine Tobacco container. Exact public availability date unknown, but believed to be before Jan. 11, 2013 for purposes of examination. (IMG_20140328_151906_518).
Photo of top of Player's Medium Navy Cut Tobacco container. Exact public availability date unknown, but believed to be before Jan. 11, 2013 for purposes of examination. (IMG_20140328_150004_185).
Photo of interior of lid of Player's Medium Navy Cut Tobacco container. Exact public availability date unknown, but believed to be before Jan. 11, 2013 for purposes of examination. (IMG_20140328_150528_201).
Photo of interior of Player's Medium Navy Cut Tobacco container. Exact public availability date unknown, but believed to be before Jan. 11, 2013 for purposes of examination. (IMG_20140328_150408_710).

* cited by examiner

CONTAINER FOR SMOKELESS TOBACCO PRODUCTS AND RELATED PACKAGED PRODUCT ASSEMBLY AND METHOD

FIELD OF THE DISCLOSURE

The present disclosure relates to containers, packaged product assemblies, and methods of use thereof. More particularly, the disclosure relates to packaging for products made or derived from tobacco, or that otherwise incorporate tobacco, and are intended for human consumption in a smokeless form.

BACKGROUND OF THE DISCLOSURE

Various types of containers for dispensing solid objects, particularly solid products intended for human consumption, are known in the art. Such containers are often characterized by a hand-held size that can be easily stored and transported. Exemplary consumable products that are often packaged in such containers include a wide variety of consumer products, including "smokeless" tobacco-related products.

Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,168,855 to Nielsen et al.; U.S. Pat. No. 8,336,557 to Kumar et al.; U.S. Pat. No. 8,469,036 to Strickland et al.; U.S. Pat. No. 8,627,828 to Strickland et al.; and U.S. Pat. No. 8,940,344 to Crawford et al.; U.S. Patent Application Pub. Nos. 2004/0020503 to Williams; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2009/0065013 to Essen et al.; and 2010/0291245 to Gao et al.; PCT Pub. Nos. WO 04/095959 to Arnarp et al.; and WO 10/132444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Snus products previously or currently available in the U.S.A. have been marketed under the trade names such as CAMEL Snus Frost, CAMEL Snus Original, and CAMEL Snus Spice, CAMEL Snus Mint, CAMEL Snus Mellow, CAMEL Snus Winterchill, and CAMEL Snus Robust by R. J. Reynolds Tobacco Company.

Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus does not require expectoration by the user.

Smokeless tobacco products have been packaged in tins, "pucks" or "pots" that are manufactured from metal or plastic such as those disclosed in U.S. Pat. No. 4,098,421 to Foster, U.S. Pat. No. 4,190,170 to Boyd, U.S. Pat. No. 8,556,070 to Bried et al., U.S. Pat. No. 8,910,781 to Pipes et al., and U.S. Patent Application Pub. Nos. 2010/0065076 to Bergstrom et al.; and 2010/0065077 to Lofgreen-Ohrn et al.; each of which is incorporated by reference herein.

A desirable feature for certain containers configured to store a product such as snus is the protection of the product from environmental effects, particularly those effects that may degrade the product stored in the container. For example, in humid environments, moisture may invade the storage space housing the product, thereby damaging the product or otherwise rendering the product unusable. Conversely, moisture may escape the product and exit the storage space, rendering the product overly dry. It would thus be desirable to provide an improved packaging for smokeless tobacco products and the like, wherein the packaging provides various advantageous features, such as protection from environmental effects.

BRIEF SUMMARY OF THE DISCLOSURE

In one aspect, a container is provided. The container may include a lid, a base, and a sealing member. The lid may include a top wall and one or more lid sidewalls extending from the top wall to a lower lip defining a lid opening. The base may be moveable with respect to the lid between a coupled configuration in which a storage compartment defined by the base is substantially sealed shut and a decoupled configuration in which the storage compartment is open. The base may include a bottom wall and one or more base sidewalls extending from the bottom wall to an upper lip defining a base opening. The one or more base sidewalls may define a channel extending around a perimeter of the one or more base sidewalls. The sealing member may be at least partially received in the channel and may extend about the perimeter of the one or more base sidewalls. The sealing member may be configured to engage the one or more lid sidewalls in the coupled configuration and to release from the one or more lid sidewalls during movement of the base with respect to the lid to the decoupled configuration.

In some embodiments the sealing member may include a body portion and one or more flexible extensions projecting from the body portion away from the one or more base sidewalls. The one or more flexible extensions may continuously extend around the perimeter of the one or more base sidewalls. The sealing member may include an elastomeric material. The elastomeric material may include a food grade silicone. The sealing member may be preformed and retained in the channel via elastic tension.

In some embodiments the sealing member may include a body portion and one or more flexible extensions extending from the body portion away from the one or more base sidewalls. The body portion of the sealing member may be substantially entirely received in the channel. The one or more flexible extensions may continuously extend from the body portion around the perimeter of the one or more base sidewalls. The flexible extensions may each be positioned at a differing height between the bottom wall and the upper lip of the base. A distance between a first lateral end of the sealing member defined by the one or more flexible extensions and a second lateral end of the sealing member defined by the body portion may be at least as long as a distance between the one or more lid sidewalls and the one or more base sidewalls at the channel.

In some embodiments the one or more base sidewalls may include an inwardly offset portion. The channel may be defined in the inwardly offset portion of the one or more base sidewalls. The inwardly offset portion of the one or more base sidewalls may define one or more protrusions projecting outwardly therefrom and configured to engage the lower lip of the lid via interference fit. The one or more base sidewalls may further include an outer portion extending from the bottom wall. The protrusions may be positioned between the channel and the outer portion of the one or more base sidewalls. The container may additionally include one or more units of a product received in the storage compartment. The product may be selected from a group consisting of pharmaceutical products, smoking products, smokeless tobacco products, and consumable products.

In an additional aspect, a method for assembling a container is provided. The method may include providing a lid. The lid may include a top wall and one or more lid sidewalls extending from the top wall to a lower lip defining a lid opening. The method may additionally include providing a base defining a storage compartment. The base may include a bottom wall and one or more base sidewalls extending from the bottom wall to an upper lip defining a base opening. The one or more base sidewalls may define a channel extending around a perimeter of the one or more base sidewalls. The method may further include providing a sealing member. Additionally, the method may include coupling the sealing member to the base at the channel such that the sealing member extends about the perimeter of the one or more base sidewalls. Further, the method may include coupling the lid to the base such that the sealing member engages the one or more lid sidewalls and the storage compartment defined by the base is substantially sealed shut.

In some embodiments the method may additionally include providing a plurality of units of a product and inserting the units of the product into the storage compartment. Further, the method may include forming the sealing member before coupling the sealing member to the one or more base sidewalls. Coupling the sealing member to the one or more base sidewalls may include stretching the sealing member around the base. Coupling the lid to the base may include directing the lower lip of the lid over one or more protrusions defined by the one or more base sidewalls.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
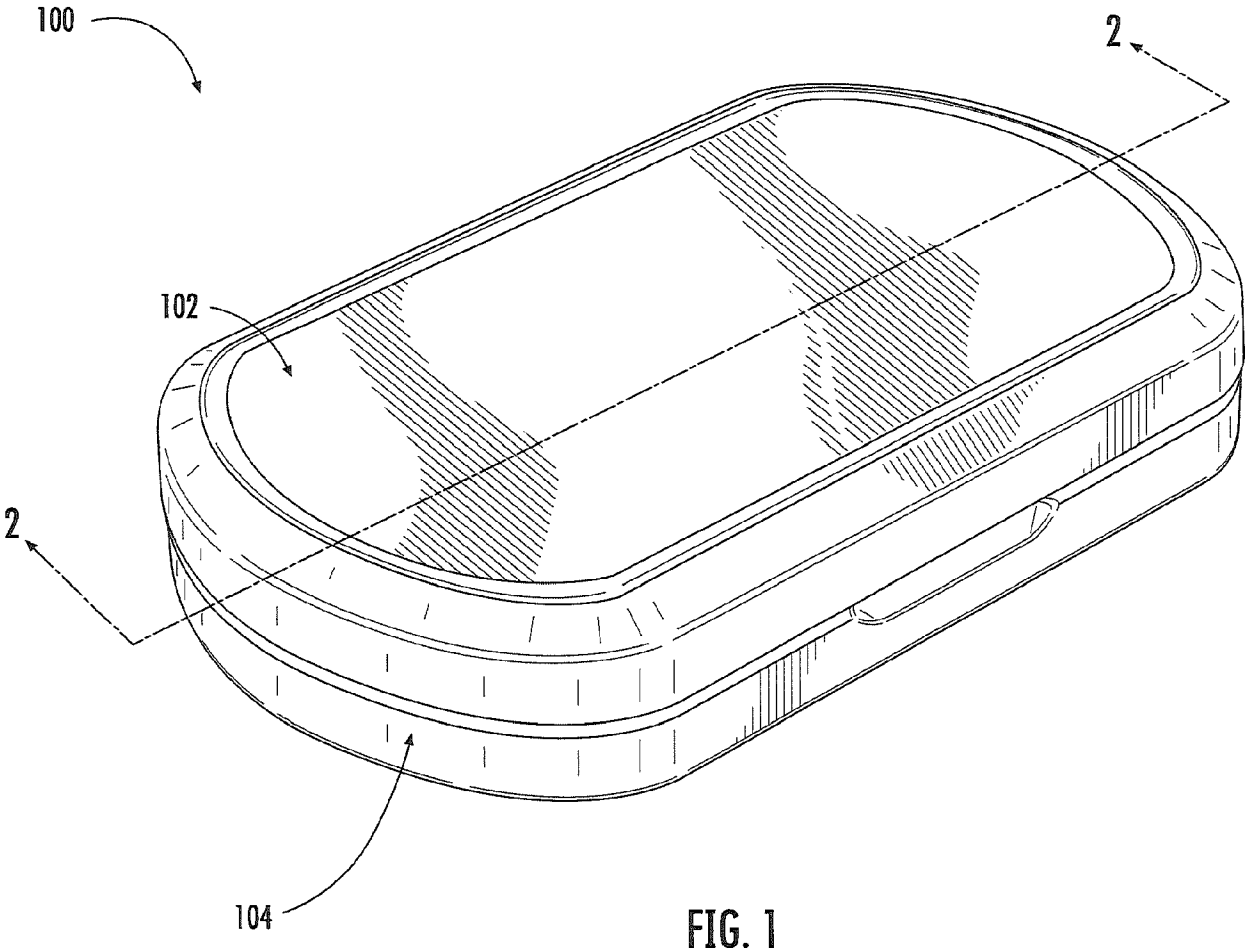
Figure 2:
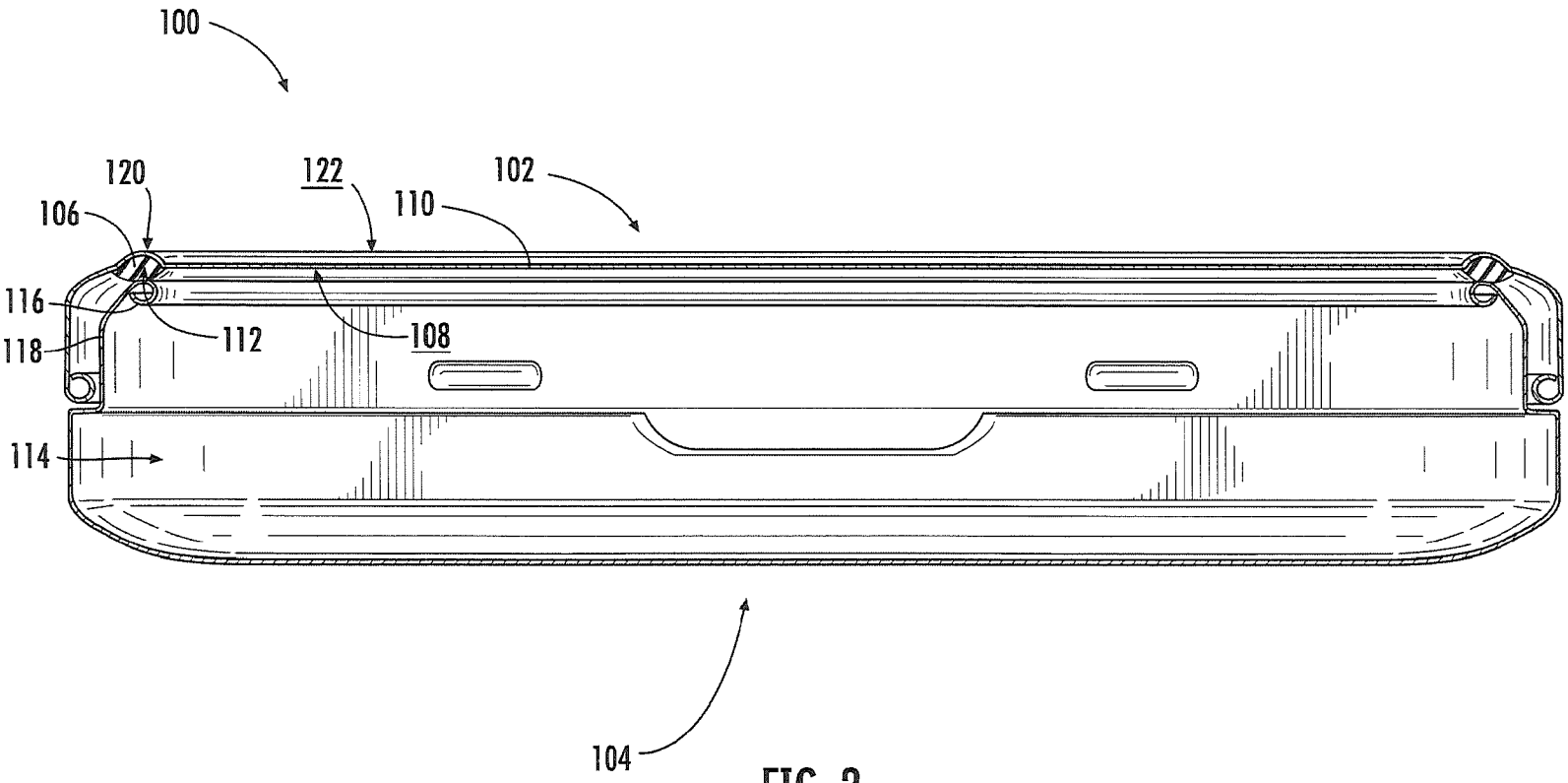
Figure 3:
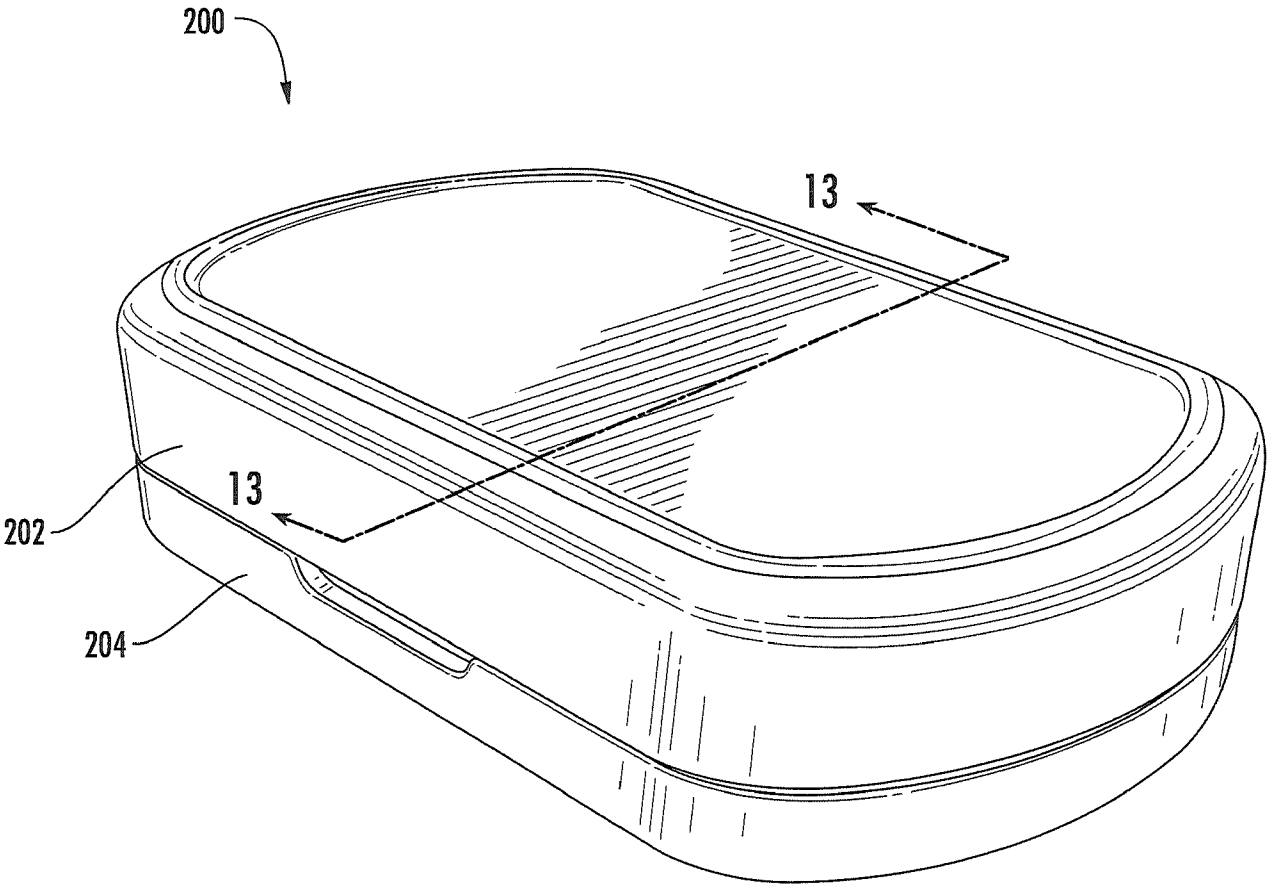
Figure 4:
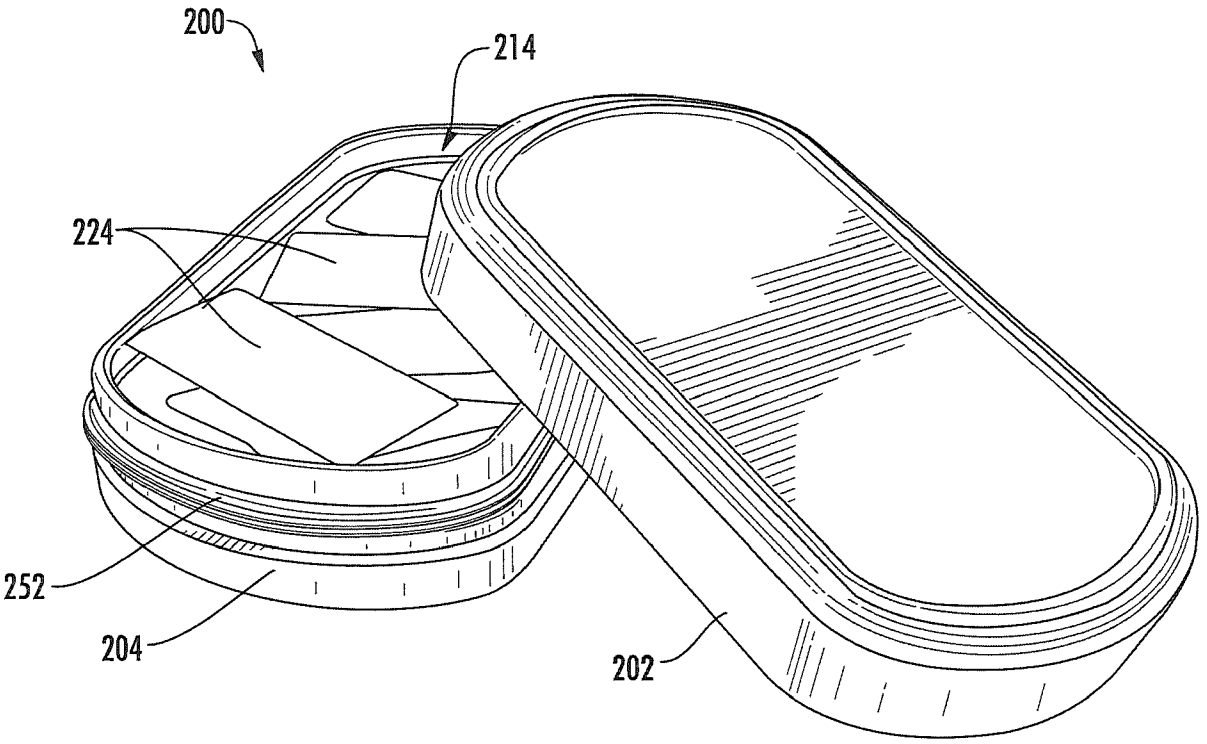
Figure 5:
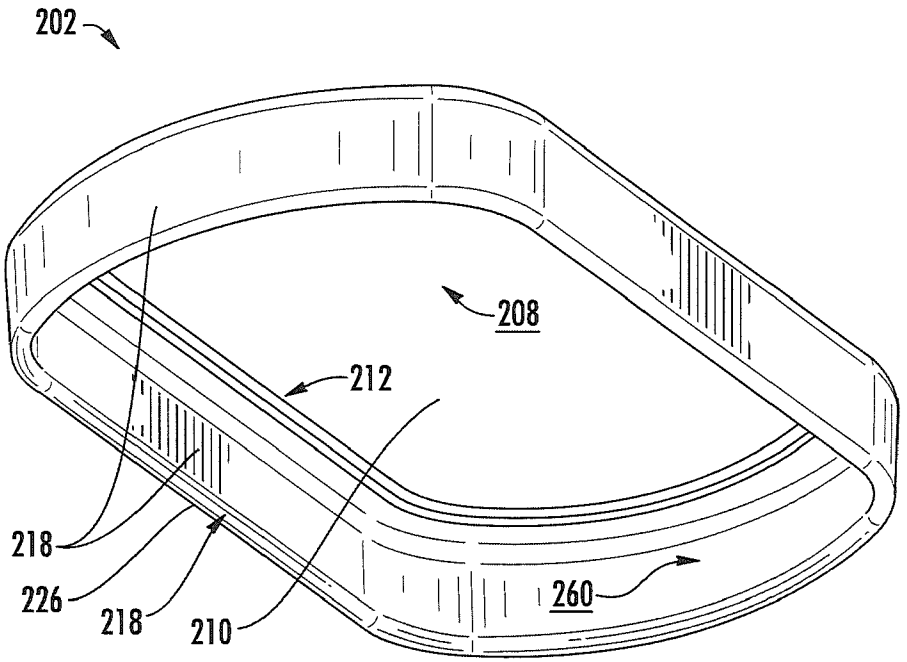
Figure 6:
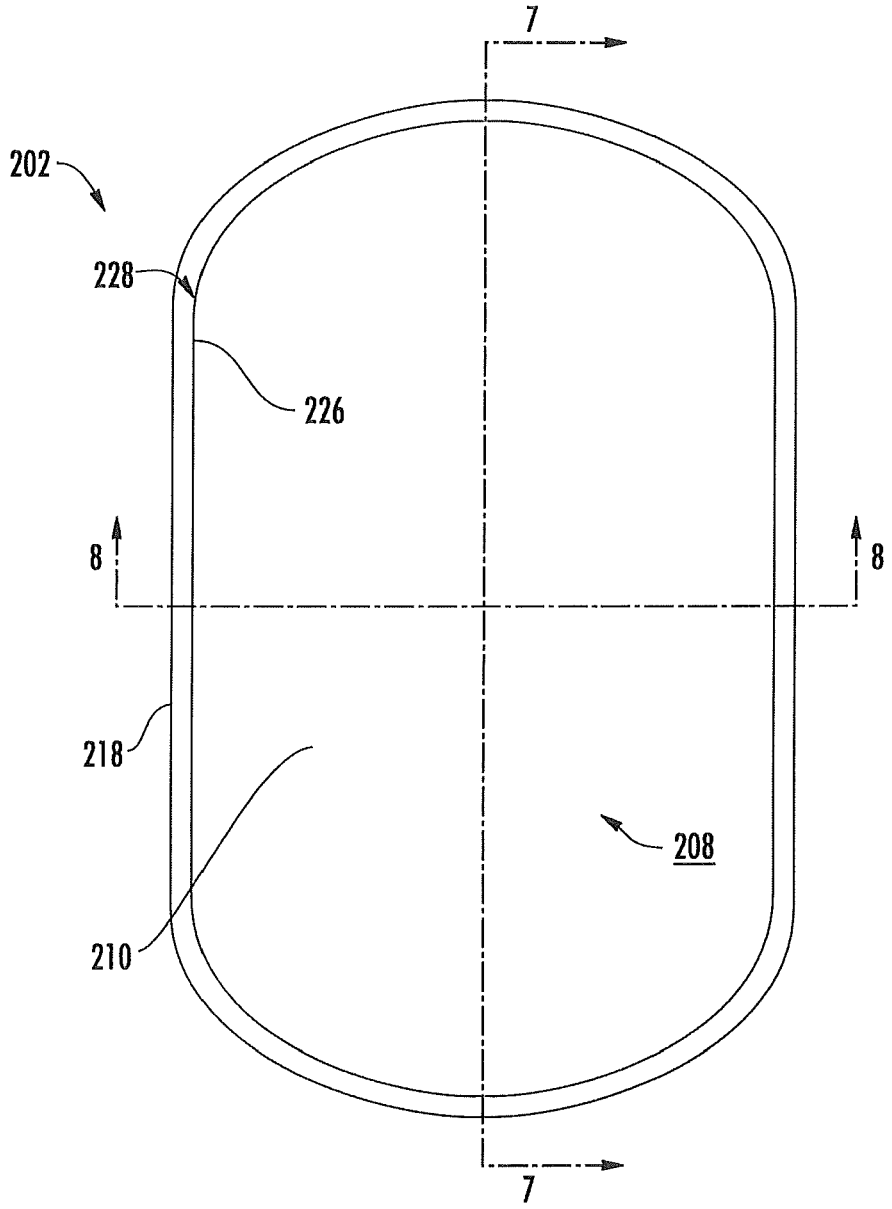
Figure 7:
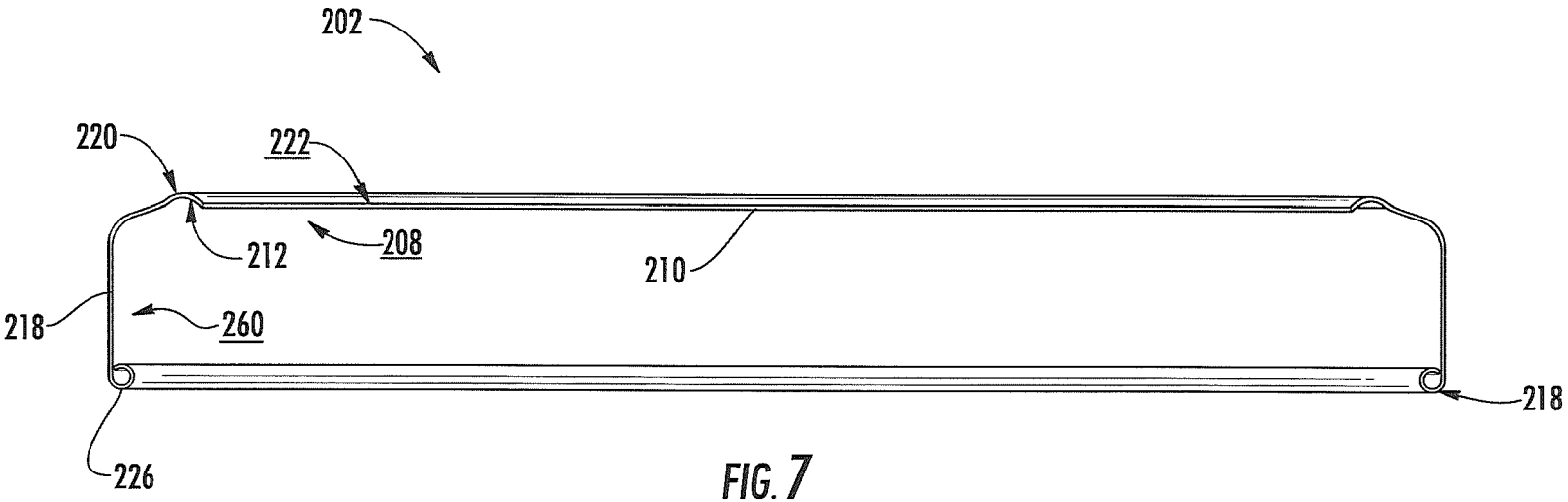
Figure 7A:
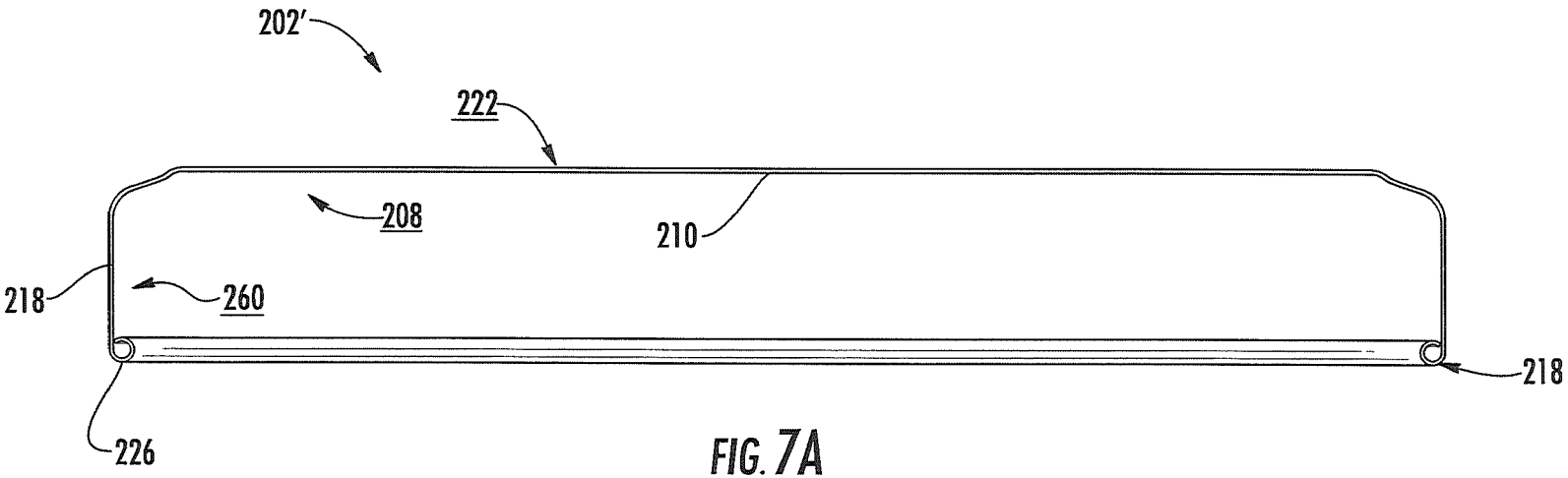
Figure 8:
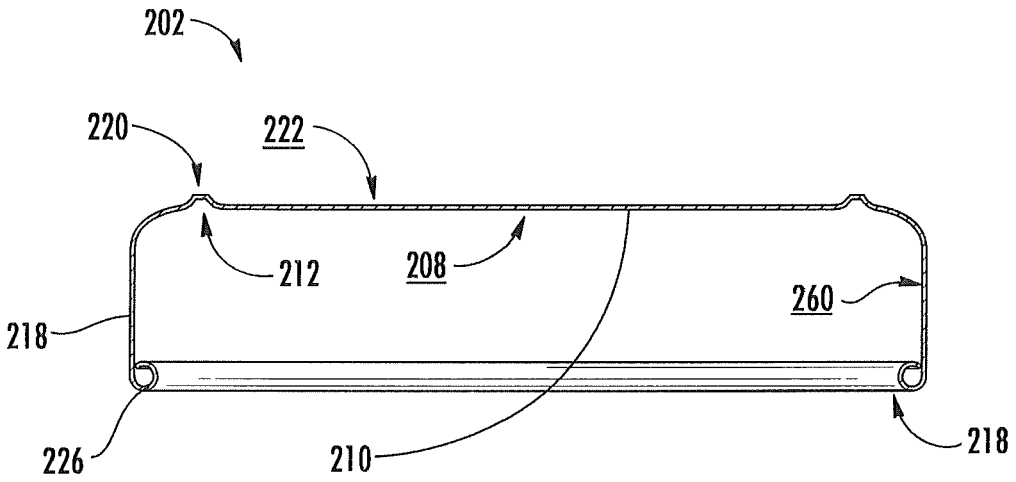
Figure 9:
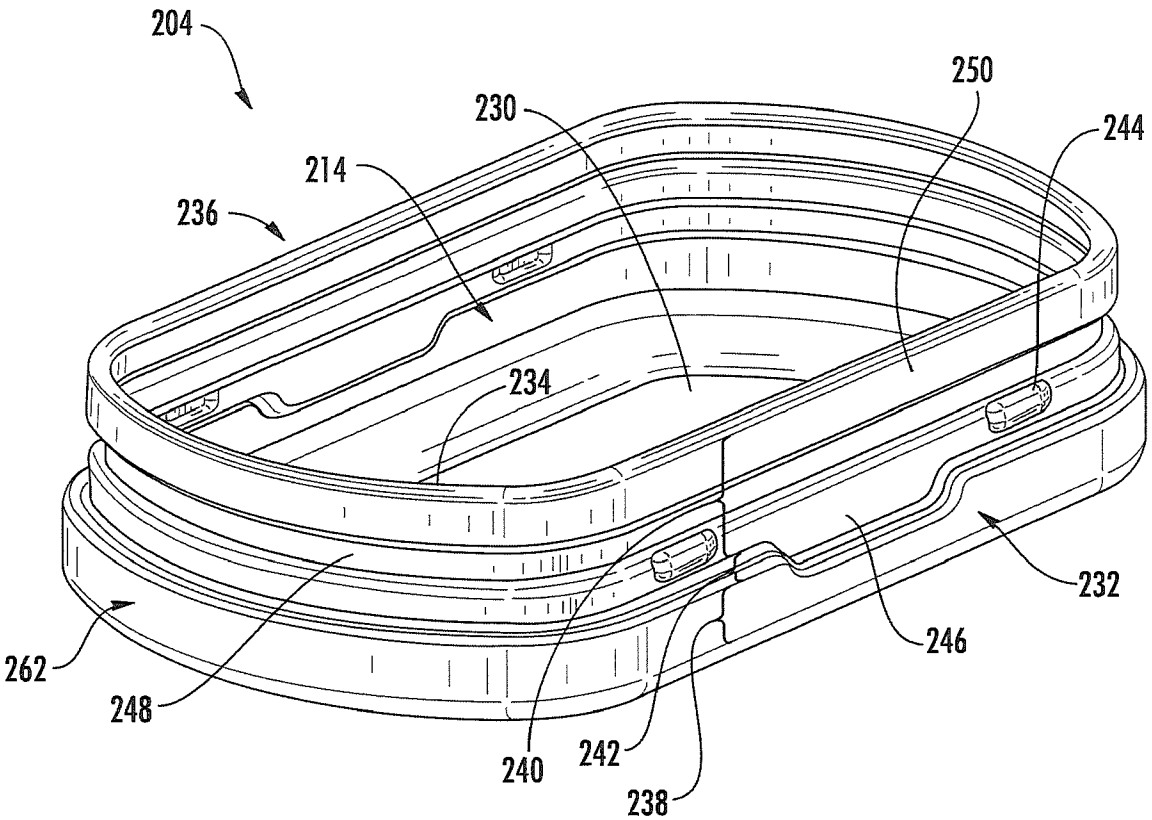
Figure 10:
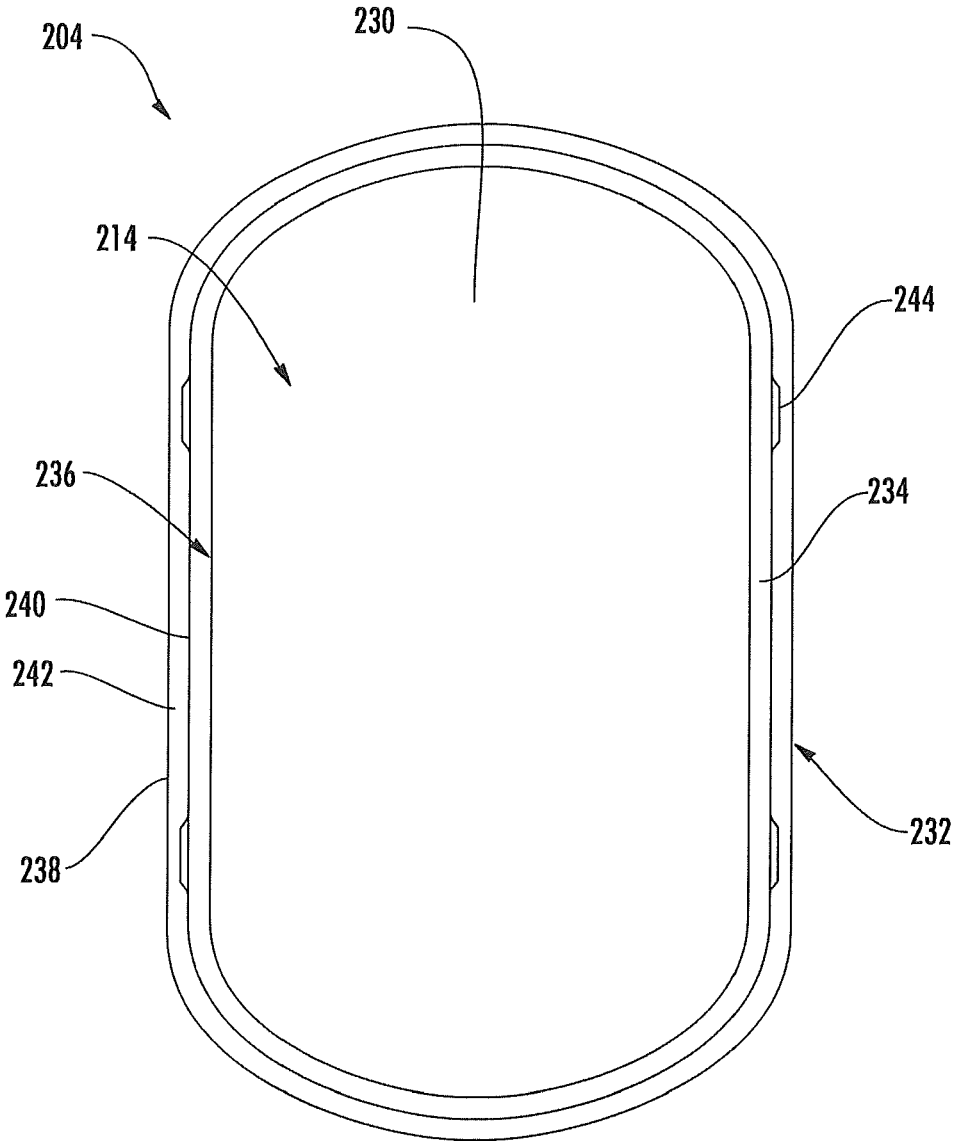
Figure 11:
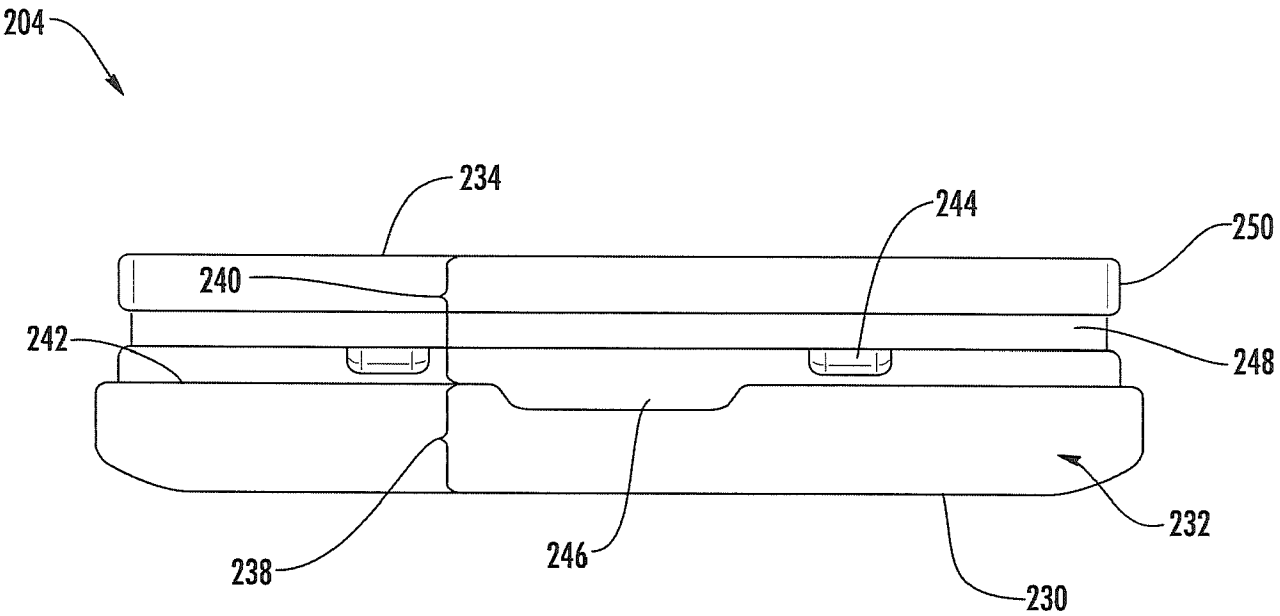
Figure 12:
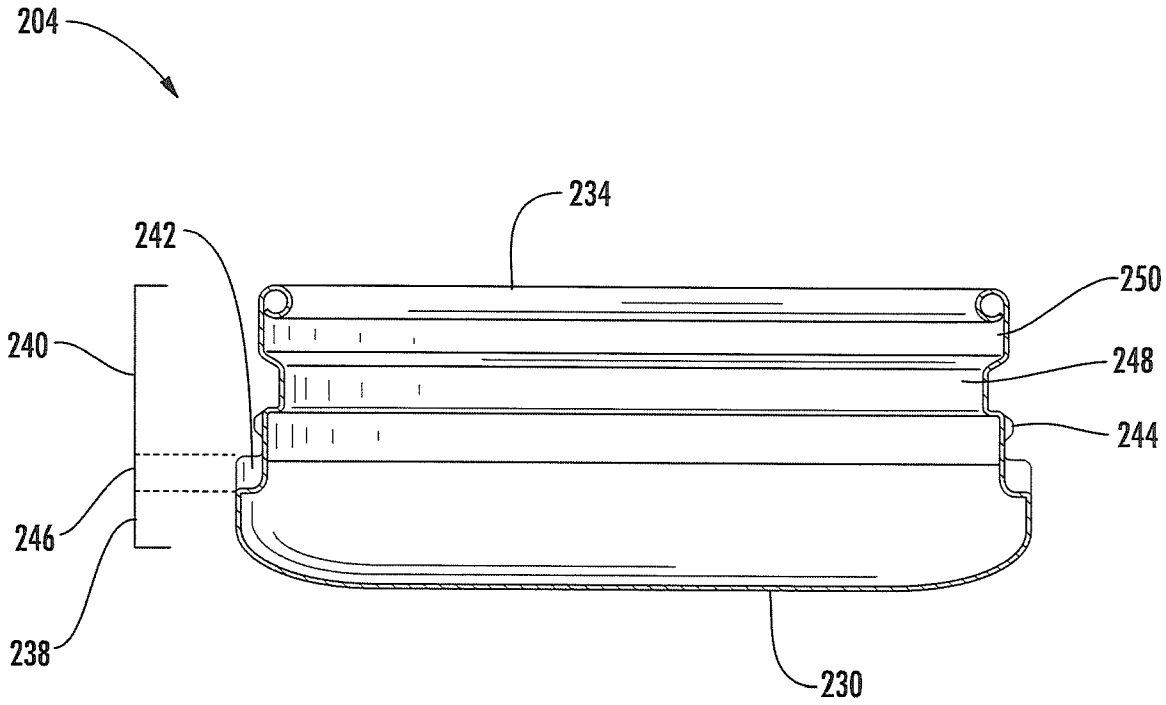
Figure 13:
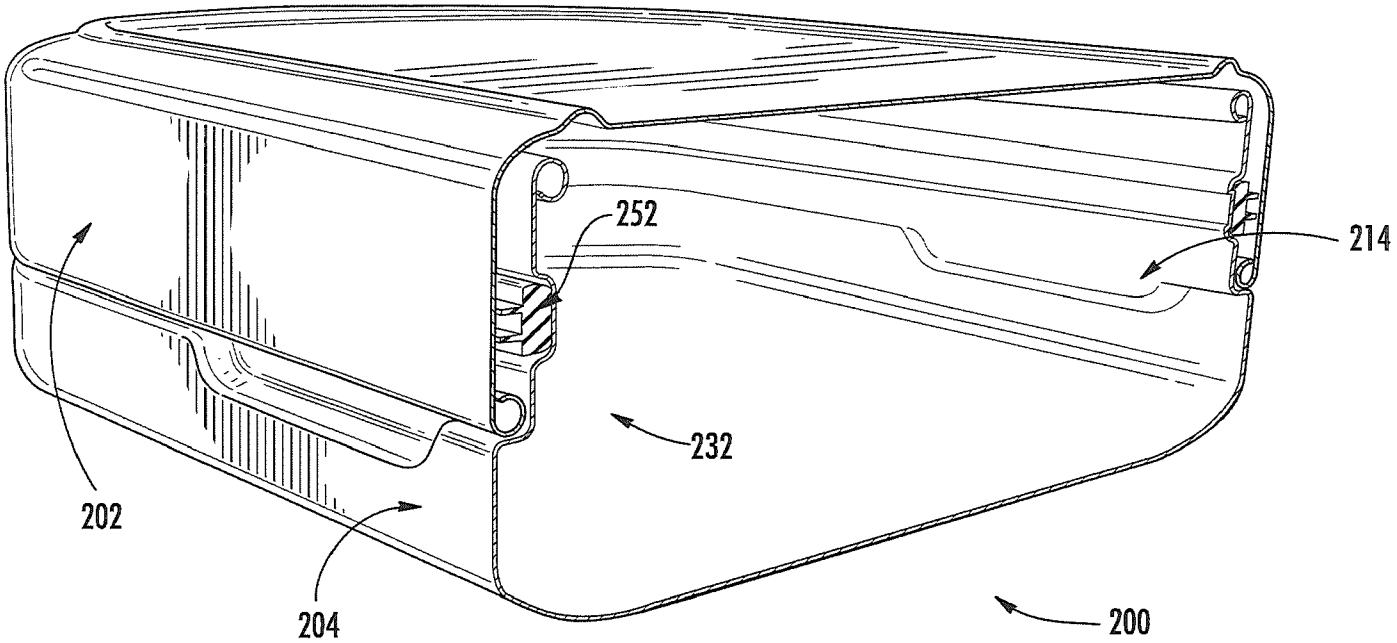
Figure 14:
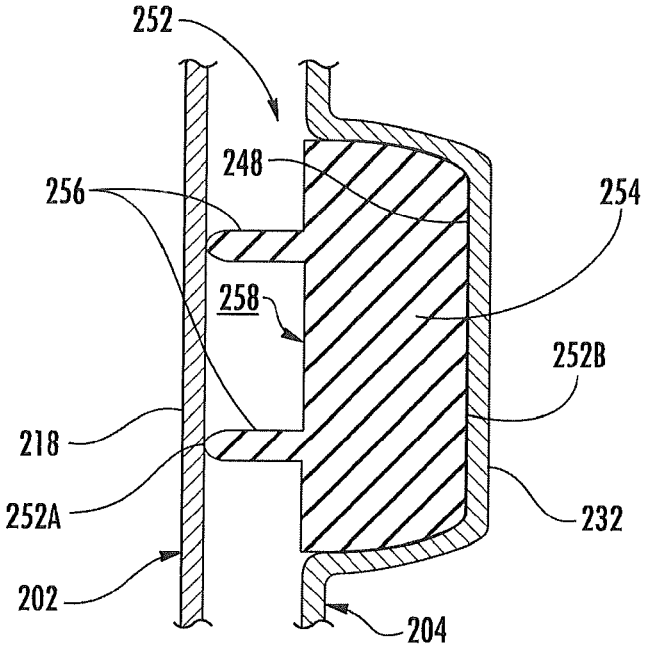
Figure 15:
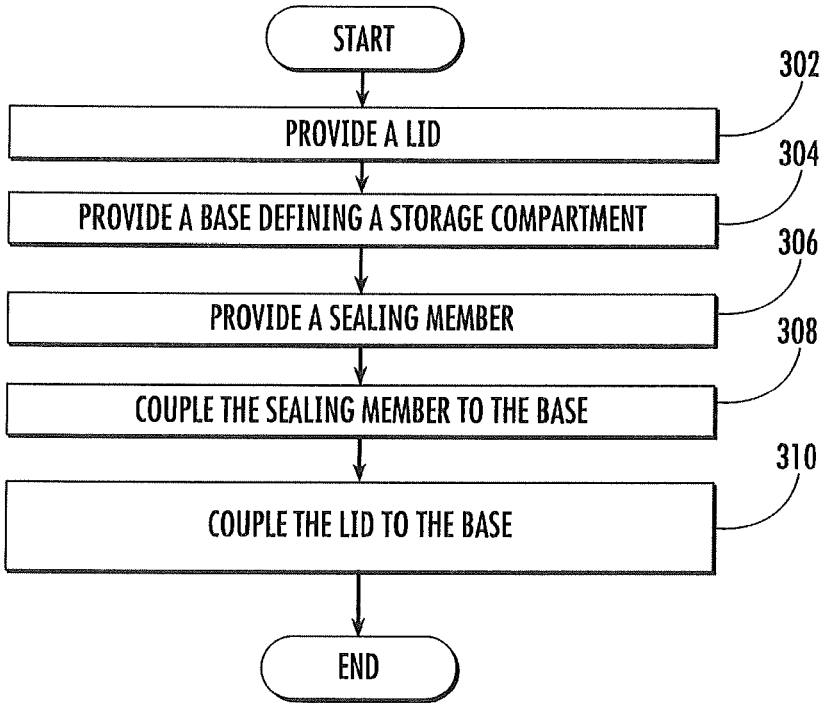

Having thus described the disclosure in general terms, reference will now be made to the accompanying drawings, which are not necessarily drawn to scale, and wherein:

FIG. 1 illustrates a perspective view of a container comprising a lid and a base in a coupled configuration according to a first example embodiment of the present disclosure;

FIG. 2 illustrates a sectional view through the container of FIG. 1 in the coupled configuration along line 2-2;

FIG. 3 illustrates a perspective view of a container comprising a lid and a base in a coupled configuration according to a second example embodiment of the present disclosure;

FIG. 4 illustrates a perspective view of the container of FIG. 3 in a decoupled configuration;

FIG. 5 illustrates a bottom perspective view of the lid of the container of FIG. 3;

FIG. 6 illustrates a bottom view of the lid of the container of FIG. 3;

FIG. 7 illustrates a sectional view through the lid of FIG. 6 along line 7-7 according to an embodiment wherein the lid includes a channel;

FIG. 7A illustrates a sectional view through the lid of FIG. 6 along line 7-7 according to an embodiment wherein the lid does not include a channel;

FIG. 8 illustrates a sectional view through the lid of FIG. 6 along line 8-8;

FIG. 9 illustrates a top perspective view of the base of the container of FIG. 3;

FIG. 10 illustrates a bottom view of the base of FIG. 9;

FIG. 11 illustrates a longitudinal side view of the base of FIG. 9;

FIG. 12 illustrates a sectional view through the base of FIG. 10 along line 12-12;

FIG. 13 illustrates a sectional view through the container of FIG. 3 along line 13-13;

FIG. 14 schematically illustrates an enlarged, partial, sectional view through the container proximate the sealing member; and FIG. 15 illustrates a schematic view of a method for assembling a container according to an example embodiment of the present disclosure.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

The embodiments of containers described in the present application can be used to store a variety of products, but are particularly well-suited for products designed for oral consumption. Exemplary consumable products that are often packaged in such containers include a wide variety of consumer products, including tobacco products in smokeless form.

Exemplary tobacco products include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner body portion region, straw-like (e.g., hollow formed) tobacco-containing shapes, sachets or packets containing tobacco (e.g., snus-like products), pieces of tobacco-containing gum, and the like. Further, exemplary tobacco products include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC.

Exemplary smokeless tobacco compositions that can be packaged in the containers of the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Pat. No. 8,469,036 to Strickland et al.; and U.S. Pat. No. 8,627,828 to Strickland et al.; and U.S. Patent Application Pub. No. 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in U.S. Patent Application Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Embodiments of containers for packaging products such as smokeless tobacco products including trays slidably received in housings are described in U.S. Pat. No. 7,946,450 to Gelardi et al.; U.S. Pat. No. 8,066,123 to Gelardi; U.S. Pat. No. 8,087,540 to Bailey et al.; U.S. Pat. No. 8,096,411 to Bailey et al.; and U.S. Patent Application Pub. Nos. 2011/0000931 to Gelardi et al. and 2010/0133140 to Bailey et al. U.S. Pat. No. 8,033,425 to Gelardi describes a hinged container for packaging products such as smokeless tobacco products. U.S. Pat. No. 6,736,261 to Thomas et al. and U.S. Pat. No. 7,014,039 to Henson et al. disclose metal containers for tobacco products with a sliding lid. U.S. Patent Application Pub. No. 2012/0193265 to Patel et al. describes a container for packaging products such as smokeless tobacco products including a separable lid and base with vent channels. U.S. Pat. No. 8,397,945 to Gelardi et al. describes a container for packaging products such as smokeless tobacco products including an outer casing and a dispensing tray. U.S. Pat. No. 8,540,113 to Bailey describes a container for packaging products such as smokeless tobacco products including a base and a lid configured to pivot and slide between open and closed positions. U.S. Patent Application Pub. No. 2014/0001194 to Pipes et al. discloses hinging containers with blister packs received therein. U.S. patent application Ser. No. 14/084,841 to Patel et al., filed Nov. 20, 2013, discloses containers including multiple compartments and an environment modification material. U.S. patent application Ser. No. 14/515,598 to Potter et al., filed Oct. 16, 2014, discloses containers including a valve assembly. All of the above-cited references are incorporated by reference herein in their entirety.

Smokeless tobacco compositions utilized as the product contained in the containers of the present disclosure will often include ingredients such as tobacco (typically in particulate form), sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The tobacco formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The tobacco formulation is in turn contained within a package, such as the containers of the present disclosure described more fully hereinbelow. The package is sealed, and is composed of a suitable material, such that the atmospheric conditions within that sealed package are modified and/or controlled. That is, the sealed package can provide a good barrier that selectively or non-selectively inhibits the passage of compositions such as moisture and oxygen therethrough. For example, the seal or gasket can be useful for inhibiting ingress of moisture while also allowing for egress of gas. In addition, the atmosphere within the sealed package can be further modified by introducing a selected gaseous species (e.g., nitrogen, argon, or a mixture thereof) into the package prior to sealing or by drawing a vacuum therein (vacuum sealing). As such, the atmospheric conditions to which the tobacco composition is exposed are controlled during conditions of one or more of preparation, packing, storage and handling.

An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

Descriptions of various components of snus products and components thereof also are set forth in U.S. Patent Application Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Patent Application Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

Although example embodiments of containers are illustrated in the drawings and described herein, it should be understood that the shape of the containers of the disclosure can vary. For example, although the container embodiments illustrated in the drawings have certain contours, containers with other exterior surface designs could also be used. Further, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions. Additionally, although the example embodiments of dimensions described herein are provided in order to achieve certain benefits, the dimensions may vary in other embodiments.

The number of solid product units stored in the containers of the disclosure can vary, depending on the size of the container and the size of the product units. Typically, the number of stored product units will vary from about 5 to about 100, more typically about 10 to about 50, and most often about 15 to about 30.

FIG. 1 illustrates a perspective view of a container 100 according to an example embodiment of the present disclosure. The container 100 may comprise a lid 102 and a base 104. The lid 102 and the base 104 may be configurable between a coupled configuration (e.g., a closed configuration) and a decoupled configuration (e.g., an open configuration). FIG. 1 illustrates the lid 102 and the base 104 in a coupled configuration in which the lid is coupled to the base.

FIG. 2 illustrates a sectional view through the container 100 along line 2-2 from FIG. 1. As illustrated, the container 100 may include a formed-in-place gasket 106 at an inner surface 108 of a top wall 110 of the lid 102. The formed-in-place gasket 106 may extend around a perimeter of the top wall 110 at the inner surface 108 thereof. In this regard, the top wall 110 of the lid 102 may define a groove 112 at the inner surface 108 thereof in which the formed-in-place gasket 106 may be at least partially received.

The formed-in-place gasket 106 may be formed from a fluid that is directed into the groove 112, such that the groove is partially or completely full of the fluid, and the fluid may be thereafter cured or otherwise transformed into a solid or semi-solid form (e.g., a gel). For example, the formed-in-place gasket 106 may comprise plastisol that is directed into the groove 112 and cured therein via the application of heat. As the plastisol is heated, the plastisol may transform from a fluid form to an air-filled gel matrix.

Accordingly, when the lid 102 and the base 104 are moved to the coupled configuration, a storage compartment 114 defined by the base may be substantially sealed shut. In this regard, an upper lip 116 defined by a sidewall 118 of the base 104 may contact and seal against the formed-in-place gasket 106 of the lid 102 when the lid and the base are moved to the coupled configuration. Various other details with respect to features that may be incorporated in the container 100 illustrated in FIGS. 1 and 2 are provided in U.S. Pat. Nos. 8,910,781, D704,050, and D692,298 to Pipes et al., which are incorporated herein by reference in their entirety.

However, usage of the above-described sealing configuration may present a number of disadvantages. In this regard, as noted above, the formed-in-place gasket 106 may be formed via the application of heat. Accordingly, in these embodiments the lid 102 must comprise a material that is resistant to the heat applied to the formed-in-place gasket 106 during the curing process. Thereby, for example, the lid 102 may comprise a metal material such as tin. Accordingly, relatively softer materials and/or materials without sufficient heat resistance such as some embodiments of plastic may not be employed in the lid 102.

Additionally, in some embodiments features such as the groove 112 may be required to form the formed-in-place gasket 106 into a desired shape (e.g., by retaining the fluid therein during curing). Formation of the groove 112 may require extra manufacturing operations (e.g., an additional stamping operation in embodiments in which the lid 102 is formed from stamped metal), which may increase the complexity and cost of manufacturing the container 100. Further, as illustrated, the groove 112 may define a bulge 120 at an outer surface 122 of the lid 102 extending proximate the perimeter thereof. In some embodiments such a bulge 120 may be undesirable for cosmetic reasons. Further, the bulge 120 may undesirably increase the height of the container 100.

In this regard, the container 100 illustrated in FIGS. 1 and 2 employs what may be referred to as a vertical sealing arrangement, in which the components of the container forming a seal between the lid 102 and the base 104 (namely, the formed-in-place gasket 106 at the lid and the lip 116 of the base) are vertically arranged in a stacked configuration when the base is resting on a horizontal surface. As may be understood, such vertical sealing arrangements may contribute to an overall increase in the vertical height of the container 100. An increase in the height of the container 100 may, for example, make the container less suitable for storage in a user's pocket, thereby detrimentally affecting the usability thereof.

Further, in embodiments in which the formed-in-place gasket 106 comprises plastisol, the plastisol may expand during the transformation from a fluid to an air-filled gel matrix. Accordingly, the plastisol may expand outwardly from the groove 112. Such expansion may cause the formed-in-place gasket 106 to become disfigured by expanding outwardly from the constraints of the groove 112. Accordingly, it may be desirable to limit the expansion of the plastisol to a desired extent. However minor variations in various factors such as the material composition of the formed-in-place gasket 106 and the heat applied during the curing process may cause the extent of expansion to differ.

Additionally, as illustrated in FIG. 2, usage of the formed-in-place gasket 106 at the inner surface 108 of the top wall 110 of the lid 102 may position the formed-in-place gasket in proximity to the storage compartment 114 in which one or more units of a product are stored. Accordingly, the material of the formed-in-place gasket 106 must be carefully selected so as to not contaminate the product in the event that the formed-in-place gasket comes into contact therewith. Further, the material of the formed-in-place gasket 106 must be selected such that contact between the product and the formed-in-place gasket does not cause damage to the formed-in-place gasket that could harm the seal provided by the formed-in-place gasket.

Accordingly, for the various reasons noted above, the formed-in-place gasket employed in the above-described container may not be desirable for inclusion in some embodiments of containers. Thus, the present disclosure is directed to embodiments of containers defining differing sealing arrangements configured to avoid some or all of the above-noted problems.

In this regard, FIG. 3 illustrates a container 200 according to an additional embodiment of the present disclosure. As illustrated, the container 200 may comprise a lid 202 and a base 204. The lid 202 and the base 204 may be configurable between a coupled configuration and a decoupled configuration. FIG. 3 illustrates the container 200 in the coupled configuration in which the lid 202 is coupled to the base 204.

FIG. 4 illustrates the lid 202 and the base 204 in the decoupled configuration. Note that although the lid 202 is illustrated as being in contact with the base 204 in FIG. 4, the lid may be fully separable from the base. In this regard, the position of the lid 202 relative to the base 204 shown in FIG. 4 is provided to illustrate differing perspective views of the lid and the base.

The material of construction of the container 200 can vary. In a preferred embodiment, both the lid 202 and the base 204 are formed from a metallic material, such as tin, aluminum, steel, or tin coated steel plate. In some embodiments the lid 202 and the base 204 may be respectively formed from a single sheet of metal via punching, stamping, trimming, forming the sheet of metal and/or via other operations. Various other materials may be employed in other embodiments including for example, wood and synthetic plastic materials. Polymeric materials that can be extruded and/or molded into desired shapes may be utilized, such as polyethylene, polystyrene, polyamide, and the like. In one embodiment the base 204 may be formed from a polymeric material, while the lid 202 may be formed from a metallic material such as, for example, aluminum or tinplate. Such a configuration may be advantageous in that it may provide an aesthetically appealing appearance by using a metallic material to form the lid 202 (which is typically stamped), while also allowing the body to be less expensively produced using, for example, an injection molding process.

As further illustrated in FIG. 4, the base 204 may define a storage compartment 214 in which one or more units of a product 224 are retained. In this regard, the base 204 may be moveable with respect to the lid 202 between the coupled configuration (see, FIG. 3) in which the storage compartment 214 defined by the base is substantially sealed shut and a decoupled configuration (see, FIG. 4) in which the storage compartment is open and thereby the units of the product 224 are accessible.

In one embodiment the product 224 may be a smokeless tobacco product. In another embodiment the product 224 may be selected from a group consisting of pharmaceutical products, smoking products, smokeless tobacco products, and consumable products. For example, as noted above, the one or more units of the product 224 may comprise tobacco-containing material such as snus. However, various other embodiments of products may be stored in the container 200.

FIGS. 5-8 illustrate the lid 202 of the container 200. In particular, FIG. 5 illustrates a perspective view of the lid 202. FIG. 6 illustrates a bottom view of the lid 202. FIG. 7 illustrates a longitudinal sectional view of the lid 202 along line 7-7 from FIG. 6. FIG. 8 illustrates a lateral sectional view of the lid 202 along line 8-8 from FIG. 6.

As illustrated, the lid 202 may include a top wall 210 and one or more lid sidewalls 218 extending from the top wall to a lower lip 226 defining a lid opening 228. In some embodiments, as illustrated in FIGS. 7 and 8, the lower lip 226 may comprise a rolled edge. Usage of a rolled edge at the lower lip 226 may preferably provide a smooth, rounded surface without sharp edges in order to protect a consumer.

As further illustrated in FIGS. 7 and 8, in some embodiments the lid 202 may include a bulge 220 at an outer surface 222 of the top wall 210. A corresponding groove 212 may be provided at an inner surface 208 of the lid. As discussed above, a groove 112 is provided at the inner surface 108 of the container 100 illustrated in FIGS. 1 and 2 to facilitate the formation of the formed-in-place gasket 106 therein.

However, embodiments of the container 200 of FIGS. 3 and 4 may not include a formed-in-place gasket at the groove 212 at the inner surface 208 of the lid 202 for the various reasons discussed above. Thus, the bulge 220 may be provided for cosmetic purposes, or the bulge and the groove 212 may be omitted in other embodiments. In this regard, eliminating the bulge 220 may desirably reduce an overall height of the container 200 substantially without adversely affecting a storage capacity of the storage compartment 214. Further, exclusion of the bulge 220 may simplify manufacturing of the container 200. In this regard, FIG. 7A illustrates an embodiment of the lid 202' wherein the top wall 210 does not include a groove defined therein.

FIGS. 9-12 illustrate the base 204 of the container 200. In particular, FIG. 9 illustrates a perspective view of the base 204. FIG. 10 illustrates a top view of the base 204. FIG. 11 illustrates a longitudinal side view of the base 204. FIG. 12 illustrates a sectional view through the base 204 along line 12-12 from FIG. 10.

As illustrated, the base 204 may comprise a bottom wall 230 and one or more base sidewalls 232. The base sidewalls 232 may extend from the bottom wall 230 to an upper lip 234. The upper lip 234 may define a base opening 236 that provides access to the storage compartment 214. The storage compartment 214 may store the one or more units of the product 224 (see, FIG. 4) therein in the coupled configuration (see, FIG. 3) and provide access to the units of product via the base opening 236 in the decoupled configuration (see, FIG. 4) in which the storage compartment is open.

The base sidewalls 232 may comprise an outer portion 238, which extends upwardly from the bottom wall 230. The outer portion 238 may extend laterally outward beyond any other portion of the base sidewalls 232. In this regard, the outer portion 238 of the base sidewalls 232 may be configured to align with the lid sidewalls 218 when the lid 202 is engaged with the base 204.

The base sidewalls 232 may further comprise an inwardly offset portion 240 that extends downwardly from the upper lip 234. The inwardly offset portion 240 of the base sidewalls 232 may be laterally inwardly offset relative to the outer portion 238 of the base sidewalls. In this regard, the lid sidewalls 218 may extend around at least part of the inwardly offset portion 240 of the base sidewalls 232 when the lid 202 is engaged with the base 204.

A shoulder portion 242 of the base sidewalls 232 may extend substantially perpendicularly to one or both of the outer portion 238 and the inwardly offset portion 240, or a portion of one or both thereof. The shoulder portion 242 may connect the outer portion 238 of the base sidewalls 232 to the inwardly offset portion 240 of the base sidewalls to provide a transition therebetween.

The inwardly offset portion 240 of the base sidewalls 232 may define one or more protrusions 244 projecting outwardly therefrom. As illustrated, in one embodiment first and second opposing sides of the base 204 may each include two of the protrusions 244 projecting therefrom. The lid may be configured to engage the protrusions 244. In particular, the lower lip 226 of the lid 202 (see, e.g., FIG. 5) may be configured to engage the protrusions 244 so as to releasably retain the container 200 in the coupled configuration.

Further, the inwardly offset portion 240 of the base sidewalls 232 may include one or more extended sections 246. The extended sections 246 of the inwardly offset portion 240 may extend downwardly, away from the upper lip 234 and toward the bottom wall 230 of the base 204. In this regard, although the outer portion 238 of the base sidewalls 232 may be positioned between the inwardly offset portion 240 and the bottom wall 230, the inwardly offset portion may overlap in height with adjacent sections of the outer portion as a result of the extended sections 246 extending downward toward the bottom wall. The extended sections 246 of the inwardly offset portion 240 may facilitate opening of the container 200 to the decoupled configuration (see, FIG. 4). In this regard, the extended sections 246 may be positioned laterally between the protrusions 244 at the first and second opposing sides of the base 204, such that a user may apply a lifting force to the lid 202 that is evenly distributed between the protrusions, to thereby avoid binding of the lid to the base 204 when lifted therefrom.

As described above, the inwardly offset portion 240 of the one or more base sidewalls 232 may include one or more protrusions 244 projecting outwardly therefrom, which may be configured to engage the lower lip 226 of the lid 202 via interference fit. Accordingly, interference between the protrusions 244 and the lower lip 226 may resist separation of the lid 202 from the base 204 when the lid and the base are in the coupled configuration. Note that use of interference fit to hold the lid 202 and the base 204 together may be desirable as compared to other retention methods. In this regard, by way of example, a threaded connection between a base and a lid may produce a seal that is dependent on the extent to which the lid and the base are threaded together. In contrast, in the present embodiment, once the lower lip 226 of the lid 202 extends past the protrusions 244, the lip and the lid may be held together by a force that is independent of the closing force imparted thereon by a user. Thus, for example, the container 200 may not be over or under tightened. Thereby, a desirable seal may be attained, and the decoupling force required to separate the lid 202 from the base 204 may be consistent. Additional description with regard to protrusions is provided in U.S. Pat. No. 8,910,781 to Pipes et al., which is incorporated herein by reference in its entirety.

As further illustrated in FIGS. 9, 11, and 12, the base sidewalls 232 may define a channel 248. The channel 248 may extend around a perimeter of the base 204 at the base sidewalls 232. In some embodiments the channel 248 may be defined at the inwardly offset portion 240. The protrusions 244 may be positioned between the channel 248 and the outer portion 238 of the one or more base sidewalls 232. Further the channel 248 may be positioned between the protrusions 244 and an upper portion 250 of the inwardly offset portion 240 that defines the upper lip 234. Thus, the channel 248 may be positioned at a relatively high position along the height of the base 204. For example, the channel 248 may be positioned relatively closer to the upper lip 234 than to the bottom wall 230. In one embodiment the channel 248 may be positioned midway along a height of the inwardly offset portion 240. However, the channel 248 may be positioned at any height along the inwardly offset portion 240.

FIG. 13 illustrates a sectional view through the container 200 in the closed configuration along line 13-13 from FIG. 3. Further, FIG. 14 schematically illustrates an enlarged cross-sectional view through a portion of the container 200 proximate the channel 248. As illustrated, the channel 248 may be configured to receive a sealing member 252.

In this regard, the channel 248 may be recessed with respect to surrounding sections of the inwardly offset portion 240 (see, e.g., FIG. 12). The sealing member 252 may extend about the perimeter of the one or more base sidewalls 232. In this regard, the sealing member 252 may be configured to engage the lid 202. By positioning the sealing member 252 such that the sealing member extends around the perimeter of the base 204, the sealing member may form a seal with the lid 202 in the coupled configuration (see, FIG. 3) that extends around the perimeter of the base so as to substantially seal the storage compartment 214 shut.

In particular, the sealing member 252 may be configured to engage the one or more lid sidewalls 218 in the coupled configuration and to release from the one or more lid sidewalls during movement of the base 204 with respect to the lid 202 to the decoupled configuration (see, FIG. 4). Thus, the sealing member 252 may be configured to releasably and repeatedly form a seal with the lid 202. Thereby, in embodiments in which the container 200 includes multiple units of the product 224 therein (see, FIG. 4), the container may repeatedly seal as units of the product 224 are sequential removed therefrom by a user and the lid 202 is recoupled to the base 204.

As further illustrated in FIG. 14, in some embodiments the sealing member 252 may include a body portion 254. The body portion 254 may also be referred to as a main body portion. In this regard, the body portion 254 may define a majority of a volume defined by the sealing member 252.

The body portion 254 of the sealing member 252 may be at least partially received in the channel 248, and in some embodiments the body portion of the sealing member may be substantially entirely received in the channel. As illustrated in FIG. 14, the size and shape of the body portion 254 of the sealing member 252 may substantially match the size and shape of the channel 248 when received therein. In this regard, the cross-sectional height and width of the body portion 254 of the sealing member 252 may substantially match the cross-sectional height and width of the channel 248. Further, when stretched and received in the channel 248, the length of the inner perimeter of the sealing member 252 may be substantially equal to the length of the outer perimeter of the base 204 at the channel 248. Thus, for example, all, or substantially all, of the body portion 254 of the sealing member 252 may be received within the channel 248.

In some embodiments the sealing member 252 may comprise an elastomeric material. Examples of elastomeric materials suitable for usage in the sealing member 252 include food grade silicone. Further, the sealing member 252 may comprise various other embodiments of materials. For example, the sealing member 252 may comprise rubber, plastic, or various other embodiments of elastomeric materials configured to form a seal. In particular, any material suitable for forming a resilient gasket can be used according to the present disclosure.

Preferably the sealing member may be formed from a material that defines one or more of resiliency, flexibility, shape integrity, positional integrity in the channel while allowing for release from the lid, good sealing characteristics, odorless, tasteless, and non-off gassing. Various other examples of materials that may be employed in the sealing member include silicone, silicone rubber Neoprene®, Chloroprene, nitrile rubbre, Buna-N, Hydrogenated Acrylonitrile, Epichlorohydrin, Ethylene-Propylene, Viton®, Fluorocarbon, Fluorosilicone, Polyurethane, Butyl, Styrene-Butadiene, Natural Rubber, Polyisoprene, Hypalon®, Polyacrylate Acrylic Ethylene Acrylic Elastomer, and Vamac®. Such materials may preferably be food grade. Seals comprising food grade silicone and seals formed from other materials suitable for usage as the sealing member are commercially available from Custom Gasket Manufacturing of Englewood Cliffs, N.J., Precision Polymer Engineering Ltd. of Blackburn, England, Henning Gasket & Seal Inc. of Chicago, Ill., and Vanguard Products Corporation of Danbury, Conn.

Further, in some embodiments the sealing member 252 may be preformed, as opposed to formed in place on the base 204. In other words, the sealing member 252 may be formed and define a stable size and shape prior to coupling to the base 204. Preforming the sealing member 252 may simplify the formation thereof and allow for production of the sealing member at a location that may differ from a location at which the base 204 is manufactured.

The sealing member 252 may stretch around the one or more sidewalls 232 of the base 204 during coupling thereto. Preforming the sealing member 252 may allow for tensioning of the sealing member during assembly with the base 204. For example, in some embodiments the length of the inner perimeter of the sealing member 252 in an unbiased configuration (e.g., an unstretched configuration, prior to coupling to the base) may be less than the length of the outer perimeter of the base 204 at the channel 248.

Accordingly, the sealing member 252 may define a state of tension when received in the channel 248. Thus, the tensile forces (e.g., elastic tension) within the sealing member 252 may retain the sealing member within the channel 248. In this regard, the sealing member 252 may be subjected to force perpendicular to the longitudinal length thereof when the lid 202 is coupled to the base 204 and decoupled therefrom. Thereby, the tensile forces may retain the sealing member 252 within the channel 248, such that the sealing member resists being pulled out of the channel. Accordingly, for example, usage of a sealant, adhesive, or other substance or mechanism for retaining the sealing member 252 in the channel 248 may be unnecessary. In this regard, usage of an adhesive or other similar substances may further complicate the assembly of the container and result in additional material costs. Additionally, tensile forces within the sealing member 252 may tightly seal the sealing member against the one or more base sidewalls 232 at the channel 248 to resist or inhibit fluid leakage therebetween, to further improve sealing of the storage compartment.

Further, as noted above, the dimensions of the body portion 254 of the sealing member 252 may substantially match the dimensions of the channel 248 when received therein. Thereby, for example, the body portion 254 of the sealing member 252 may sit substantially flush with surrounding portions of the inwardly offset portion 240 (see, e.g., FIG. 12) of the one or more base sidewalls 232. By sizing and positioning the sealing member 252 such that the body portion 254 is substantially flush with the surround portions of the inwardly offset portion 240, or recessed within the channel 248, issues with respect to the lower lip 226 (see, e.g., FIG. 8) of the lid 202 catching on the body portion and pulling the body portion out of the channel during movement to or from the coupled configuration may be avoided. However, in other embodiments the body portion 254 of the sealing member 252 may project outwardly from the channel 248 to facilitate sealing with the lid 202.

Usage of an elastomeric material may allow the sealing member 252 to compress or otherwise deform during engagement with the lid 202 to form a tight seal therewith. In some embodiments the seal provided by the sealing member 252 may comprise a hermetic seal. However, in other embodiments the seal provided by the sealing member 252 may comprise a non-hermetic seal. The selection of the sealing member 252 and the configuration thereof in terms of providing a hermetic or non-hermetic seal may be based upon the particular type of units of the product 224 (see, FIG. 4) received in the storage compartment 214.

The sealing member 252 may include additional or alternative features configured to form a tight seal with the lid 202. In this regard, as illustrated in FIG. 14, the sealing member 252 may further comprise one or more flexible extensions 256. The flexible extensions 256 may project from the body portion 254. When the sealing member 252 is received in the channel 248, the flexible extensions may extend away from the one or more base sidewalls 232. A distance between a first lateral end 252A of the sealing member 252 defined by the one or more flexible extensions 256 and a second lateral end 252B of the sealing member defined by the body portion 254 may be at least as long as a distance between the one or more lid sidewalls 218 and the one or more base sidewalls 232 at the channel 248. Thereby, the body portion 254 of the sealing member 252 may seal against the base 204 at the channel 248 and the one or more flexible extensions 256 may seal against the one or more lid sidewalls 218.

The flexible extensions 256 may be configured to form an improved seal with the lid 202. In this regard, the flexible extensions 256 may be elongated and thin such that the flexible extensions define enhanced flexibility. Further, in some embodiments the flexible extensions 256 may extend substantially perpendicularly from an outer face 258 defined by the main body portion 254 to encourage bending of the flexible extensions.

For example, as illustrated in FIGS. 7 and 8, the lower lip 226 of the lid 202 may extend inwardly relative to a remainder of the one or more lid sidewalls 218. Accordingly, in order for the sealing member 252 to seal against an inner surface 260 of the lid sidewalls 218 and allow the lower lip 226 of the lid 202 to pass the sealing member during coupling and decoupling of the lid and the base 204, the sealing member may be configured to compress, flex, or otherwise elastically distort to allow the lower lip of the lip to pass the sealing member during coupling and decoupling of the lid and the base.

As illustrated in FIG. 14, in one embodiment the sealing member 252 includes two flexible extensions 256. Usage of a plurality of the flexible extensions 256 may improve the seal between the sealing member 252 and the lid sidewalls 218. In this regard, in some embodiments the flexible extensions 256 may continuously extend outwardly from the body portion 254 around the perimeter of the one or more base sidewalls 232. Thereby, each flexible extension 256 may be configured to seal shut the storage compartment 214 relative to an external environment surrounding the container.

Each flexible extension 256 may be configured to independently bend and articulate. Further, the flexible extensions 256 may each be positioned at a differing height between the bottom wall 230 and the upper lip 234 of the base 204. In this regard, the flexible extensions 256 may be spaced apart from one another at a distance and define a length less than the distance at which the flexible extensions are spaced. Thus, the flexible extensions 256 may not contact one another when one of the flexible extensions is bent or when multiple extensions are bent in the same direction, as may occur during ordinary use of the container 200. As such, each flexible extension 256 may not interfere with the sealing of adjacent flexible extensions during ordinary use.

Each individual flexible extension 256 may provide a seal, which may seal the storage compartment 214. Thereby, in the event of one of the flexible extensions 256 becoming damaged or otherwise forming a compromised seal with respect to the lid 202, so long as one other flexible extension forms a proper seal with the lid, the storage compartment 214 may remain sealed. Thus, the flexible extensions 256 may provide an improved seal as compared to embodiments in which a single sealing member is employed.

For example, the presence of contaminants (e.g., tobacco particles) at the inner surface 260 (see, e.g., FIG. 5) of the one or more lid sidewalls 218 may impair sealing. However, the flexible extensions 256 may offer redundant protection in the event that one or more of the flexible extensions fails to form a seal with respect to the one or more lid sidewalls 218, as noted above. Further, the flexible extensions 256 may wipe away contaminants from the one or more lid sidewalls 218 during coupling and decoupling of the lid 202 to the base 204. Accordingly, instances of compromise of the seal caused by contaminants may be further mitigated as a result of the cleaning action performed by the flexible extensions 256 during coupling and decoupling of the lid 202 and the base 204. Thus, the position of the sealing member 252 at the one or more base sidewalls 232, instead of other locations such as the top wall 210 of the lid 202, may provide benefits as a result of the flexible extensions 256 performing a cleaning function.

Further, by positioning the sealing member 252 at an outer surface 262 (see, FIG. 9) of the one or more base sidewalls 232, the sealing member 252 may be less likely to contact the units of the product 224 (see, FIG. 4) or any portion thereof (e.g., tobacco particles), so that the product may be less likely to adversely affect the seal formed between the lid 202 and the base 204 as compared to embodiments of containers wherein the upper lip of the base sidewall seals against a sealing member positioned at the inner surface of the top wall of the lid. In this regard, by positioning the sealing member 252 at the outer surface 262 (see, e.g., FIG. 9) of the one or more base sidewalls 232, the sealing member may not be in direct contact with the one or more units of the product 224 (see, FIG. 4) during ordinary use. Thereby, contaminants may be less likely to reach the sealing member 252.

As described above, the sealing member 252 may be coupled to the outer surface 262 (see, FIG. 9) of the one or more base sidewalls 232 and configured to releasably seal against the inner surface 260 (see, e.g., FIG. 5) of the one or more lid sidewalls 218 to provide the various benefits described above. In an alternate embodiment the sealing member may be coupled to the lid and configured to engage the base. For example, the sealing member may be coupled to the inner surface of the one or more lid sidewalls and configured to engage the outer surface of the one or more base sidewalls. However, this configuration may not be suitable for use with a preformed sealing member. In this regard, placement of the sealing member at the inner surface of the one or more base sidewalls may not allow for tensioning of the sealing member. Accordingly, placement of the sealing member at the outer surface of the one or more base sidewalls may be preferable.

As noted above, the container 200 may be filled with one or more units of a product 224 (see, FIG. 4). As part of the final packaging process, once the container is filled with the one or more units of the product, the container may be sealed with a circumferential label or wrapper of a pervious or impervious material. In one embodiment a tamper evident shrink band may be wrapped and shrunken around the container such that the lid and the base may not be decoupled without damaging the shrink band. The label or wrapping material useful in accordance with the present disclosure can vary. Typically, the selection of the packaging label or wrapper is dependent upon factors such as aesthetics, tamper resistance and/or indication, desired barrier properties (e.g., so as to provide protection from exposure to oxygen, or so as to provide protection from loss of moisture), or the like. However, as noted above, contact between the sealing member and the base and between the sealing member and the lid may provide a seal.

A method for assembling a container is also provided. As illustrated in FIG. 15, the method may include providing a lid at operation 302. The lid may comprise a top wall and one or more lid sidewalls extending from the top wall to a lower lip defining a lid opening. The method may additionally include providing a base defining a storage compartment at operation 304. The base may comprise a bottom wall and one or more base sidewalls extending from the bottom wall to an upper lip defining a base opening. The one or more base sidewalls may define a channel extending around a perimeter of the one or more base sidewalls. Further, the method may include providing a sealing member at operation 306. Additionally, the method may include coupling the sealing member to the base at the channel such that the sealing member extends about the perimeter of the one or more base sidewalls at operation 308. The method may further include coupling the lid to the base such that the sealing member engages the one or more lid sidewalls and the storage compartment defined by the base is substantially sealed shut at operation 310.

In some embodiments the method may further comprise providing a plurality of units of a product and inserting the units of the product into the storage compartment. Additionally, the method may include forming the sealing member before coupling the sealing member to the one or more base sidewalls at operation 308. Coupling the sealing member to the one or more base sidewalls at operation 308 may comprise stretching the sealing member around the base. Further, coupling the lid to the base at operation 310 may comprise directing the lower lip of the lid over one or more protrusions defined by the one or more base sidewalls.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A container, comprising:

a lid, comprising:

a top wall, and one or more lid sidewalls extending from the top wall to a lower lip defining a lid opening; and a base moveable with respect to the lid between a coupled configuration in which a storage compartment defined by the base is substantially sealed shut and a decoupled configuration in which the storage compartment is open, the base comprising:

a bottom wall, and one or more base sidewalls extending from the bottom wall to an upper lip defining a base opening, the one or more base sidewalls defining a channel extending around a perimeter of the one or more base sidewalls; and a sealing member at least partially received in the channel and extending about the perimeter of the one or more base sidewalls, the sealing member comprising a body portion and one or more flexible extensions extending from the body portion away from the one or more base sidewalls to a lateral end configured to engage an inner surface of the one or more lid sidewalls surrounding the base sidewalls in the coupled configuration and to release from the one or more lid sidewalls during movement of the base with respect to the lid to the decoupled configuration.

2. The container of claim 1, wherein the sealing member comprises an elastomeric material.

3. The container of claim 2, wherein the elastomeric material comprises a food grade silicone.

4. The container of claim 2, wherein the sealing member is preformed and retained in the channel via elastic tension.

5. The container of claim 1, wherein the body portion of the sealing member is substantially entirely received in the channel.

6. The container of claim 1, wherein the one or more flexible extensions continuously extend from the body portion around the perimeter of the one or more base sidewalls.

7. The container of claim 1, wherein a distance between a first lateral end of the sealing member defined by the one or more flexible extensions and a second lateral end of the sealing member defined by the body portion is at least as long as a distance between the one or more lid sidewalls and the one or more base sidewalls at the channel.

8. The container of claim 1, wherein the sealing member comprises a plurality of the flexible extensions and the flexible extensions are each positioned at a differing height between the bottom wall and the upper lip of the base.

9. The container of claim 1, wherein the one or more base sidewalls comprise an inwardly offset portion.

10. The container of claim 9, wherein the channel is defined in the inwardly offset portion of the one or more base sidewalls.

11. The container of claim 9, wherein the inwardly offset portion of the one or more base sidewalls defines one or more protrusions projecting outwardly therefrom and configured to engage the lower lip of the lid via interference fit.

12. The container of claim 11, wherein the one or more base sidewalls further comprise an outer portion extending from the bottom wall, the one or more protrusions being positioned between the channel and the outer portion of the one or more base sidewalls.

13. The container of claim 1, further comprising one or more units of a product received in the storage compartment.

14. The container of claim 13, wherein the product is selected from a group consisting of pharmaceutical products, smoking products, smokeless tobacco products, and consumable products.

15. A method for assembling a container, comprising:

providing a lid, comprising:

a top wall, and one or more lid sidewalls extending from the top wall to a lower lip defining a lid opening;

providing a base defining a storage compartment, the base comprising:

a bottom wall, and one or more base sidewalls extending from the bottom wall to an upper lip defining a base opening, the one or more base sidewalls defining a channel extending around a perimeter of the one or more base sidewalls;

providing a sealing member comprising a body portion and one or more flexible extensions;

coupling the sealing member to the base at the channel such that the sealing member extends about the perimeter of the one or more base sidewalls and the flexible extensions extend from the body portion away from the one or more base sidewalls to a lateral end;

coupling the lid to the base such that the lateral end of each of the one or more flexible extensions of the sealing member engages an inner surface of the one or more lid sidewalls surrounding the base sidewalls and the storage compartment defined by the base is substantially sealed shut.

16. The method of claim 15, further comprising providing a plurality of units of a product; and inserting the units of the product into the storage compartment.

17. The method of claim 15, further comprising forming the sealing member before coupling the sealing member to the one or more base sidewalls.

18. The method of claim 17, wherein coupling the sealing member to the one or more base sidewalls comprises stretching the sealing member around the base.

19. The method of claim 15, wherein coupling the lid to the base comprises directing the lower lip of the lid over one or more protrusions defined by the one or more base sidewalls.

* * * * *